US005754011A

United States Patent [19]

Frus et al.

[11] Patent Number: 5,754,011

[45] Date of Patent: May 19, 1998

[54] METHOD AND APPARATUS FOR CONTROLLABLY GENERATING SPARKS IN AN IGNITION SYSTEM OR THE LIKE

[75] Inventors: John R. Frus; Michael J. Cochran, both of Jacksonville, Fla.

[73] Assignee: Unison Industries Limited Partnership, Jacksonville, Fla.

[21] Appl. No.: 502,713

[22] Filed: Jul. 14, 1995

[51] Int. Cl.[6] ..... H05B 37/02

[52] U.S. Cl. ..... 315/209 SC; 123/148 CB

[58] Field of Search ..... 315/209 T, 209 SC; 123/148 CB

[56] References Cited

U.S. PATENT DOCUMENTS

| | | |
|---|---|---|
| 2,717,335 | 9/1955 | Sims et al. . |
| 2,896,123 | 7/1959 | McNulty . |
| 2,938,147 | 5/1960 | Rose . |
| 2,980,822 | 4/1961 | Short . |
| 2,985,797 | 5/1961 | Williams et al. . |
| 2,995,685 | 8/1961 | Lord . |
| 3,045,148 | 7/1962 | McNulty et al. . |
| 3,049,642 | 8/1962 | Quinn . |
| 3,169,212 | 2/1965 | Walters . |
| 3,223,887 | 12/1965 | Brown . |
| 3,240,198 | 3/1966 | Loudon et al. . |

(List continued on next page.)

FOREIGN PATENT DOCUMENTS

| | | |
|---|---|---|
| 369236 | 8/1988 | European Pat. Off. . |
| 228840 B1 | 7/1991 | European Pat. Off. . |
| 529558 | 11/1940 | United Kingdom . |
| 633854 | 12/1949 | United Kingdom . |
| 637286 | 5/1950 | United Kingdom . |
| 661410 | 11/1951 | United Kingdom . |
| 682877 | 11/1952 | United Kingdom . |
| 762097 | 11/1956 | United Kingdom . |
| 762119 | 11/1956 | United Kingdom . |
| 808991 | 2/1959 | United Kingdom . |

(List continued on next page.)

OTHER PUBLICATIONS

High Energy Igniters, G.N. Burland, Aerospace, Jan. 1984 pp. 28–31.

Interrelated Parameters for Gas Turbine Engine Design and Electrical Ignition Systems, M.W. Burgher, Apr. 1963.

Lucas Aerospace Overhaul Manual, Type NB.10605 High Energy Ignition Unit (Jul., 1978), Fig. 2.

SAE Aerospace Information Report AIR 784A (1975).

Solid State Ignition Systems, Chapters 3–5 Graf and Whalen, 1974.

*Primary Examiner*—Robert Pascal
*Assistant Examiner*—Michael Shingleton
*Attorney, Agent, or Firm*—Leydig, Voit & Mayer, Ltd.

[57] ABSTRACT

An apparatus for controllably generating sparks is provided. The apparatus includes a spark generating device; at least two output stages connected to the spark generating device; means for charging energy storage devices in the output stages and at least partially isolating each of the energy storage devices from the energy storage devices of the other output stages; and, a logic circuit for selectively triggering the output stages to generate a spark. Each of the output stages preferably includes: (1) an energy storage device to store the energy; (2) a controlled switch for selectively discharging the energy storage device; and (3) a network for transferring the energy discharged by the energy storage device to the spark generating device. In accordance with one aspect of the invention, the logic circuit, which is connected to the controlled switches of the output stages, can be configured to fire the stages at different times, in different orders, and/or in different combinations to provide the spark generating device with output pulses having substantially any desired waveshape and energy level to thereby produce a spark having substantially any desired energy level and plume shape at the spark generating device to suit any application.

62 Claims, 10 Drawing Sheets

U.S. PATENT DOCUMENTS 3,302,629 2/1967 Shano .
3,331,033 7/1967 Johnston .
3,395,686 8/1968 Minks .
3,407,795 10/1968 Aiken et al. .
3,421,825 1/1969 Maycock .
3,424,945 1/1969 Seider et al. .
3,450,942 6/1969 Segall et al. .
3,504,658 4/1970 Chavis .
3,505,563 4/1970 Randall et al. .
3,534,719 10/1970 Minks .
3,546,528 12/1970 Fisher .
3,556,706 1/1971 Campbell .
3,560,833 2/1971 Oishi et al. .
3,569,727 3/1971 Aggarwal et al. .
3,571,609 3/1971 Knudson .
3,575,153 4/1971 Hardin et al. .
3,583,378 6/1971 Pattee .
3,584,929 6/1971 Schuette .
3,600,887 8/1971 Gault .
3,629,652 12/1971 Maycock .
3,635,202 1/1972 Issler et al. .
3,675,077 7/1972 Minks .
3,681,001 8/1972 Potts .
3,716,758 2/1973 Palazztti .
3,731,144 5/1973 McKeown .
3,740,589 6/1973 Minks .
3,750,637 8/1973 Minks .
3,769,545 10/1973 Crane .
3,806,305 4/1974 Dietz et al. .
3,818,885 6/1974 Canup .
3,824,432 7/1974 Gersing .
3,835,350 9/1974 Thakore .
3,838,328 9/1974 Lundy .
3,839,659 10/1974 Bruijning et al. .
3,849,670 11/1974 Lourigan .
3,857,376 12/1974 Williams .
3,869,645 3/1975 Collins .
3,889,160 6/1975 Cobarg .
3,894,273 7/1975 Newport, Jr. et al. .
3,906,919 9/1975 Asik et al. .
3,910,246 10/1975 Canup .
3,918,425 11/1975 Pulzer .
3,958,168 5/1976 Grundberg .
3,961,613 6/1976 Canup .
4,004,561 1/1977 Thieme ..... 123/148 CB
4,027,198 5/1977 Linkroum .
4,032,842 6/1977 Green et al. .
4,122,816 10/1978 Fitzgerald et al. .
4,129,895 12/1978 Witting .
4,136,301 1/1979 Shimojo et al. .
4,154,205 5/1979 Förster .
4,167,767 9/1979 Courier de Mere .
4,191,911 3/1980 Gerry .
4,203,052 5/1980 Bechtel .
4,245,609 1/1981 Gerry .
4,247,880 1/1981 Morio .
4,261,025 4/1981 Chafer et al. .
4,277,728 7/1981 Stevens ..... 315/247
4,285,321 8/1981 Phelon et al. .
4,329,628 5/1982 Bohan, Jr. .
4,349,008 9/1982 Wainwright .
4,414,804 11/1983 Menard et al. .
4,479,467 10/1984 Burrows et al. .
4,502,454 3/1985 Hamai et al. .
4,510,915 4/1985 Ishikawa et al. .
4,522,184 6/1985 Lepley .
4,535,380 8/1985 Geary .
4,561,707 12/1985 Jackson .
4,589,398 5/1986 Pate et al. .
4,613,797 9/1986 Eggers et al. .
4,688,538 8/1987 Ward et al. .
4,696,280 9/1987 Niggemeyer .
4,705,013 11/1987 Minks .
4,774,924 10/1988 Minks .
4,829,971 5/1989 Minks .
4,833,369 5/1989 White .
4,839,772 6/1989 Choi et al. .
4,922,396 5/1990 Niggemeyer .
4,983,886 1/1991 Balland .
5,032,969 7/1991 Eggers et al. .
5,065,073 11/1991 Frus .
5,148,084 9/1992 Frus .
5,178,120 1/1993 Howson et al. .
5,245,252 9/1993 Frus et al. .

FOREIGN PATENT DOCUMENTS 896161 5/1962 United Kingdom .
962417 7/1964 United Kingdom .
992288 5/1965 United Kingdom .
1018963 2/1966 United Kingdom .
1027259 4/1966 United Kingdom .
1035656 7/1966 United Kingdom .
1037664 8/1966 United Kingdom .
1045812 10/1966 United Kingdom .
1063257 3/1967 United Kingdom .
997257 3/1967 United Kingdom .
1085434 10/1967 United Kingdom .
1102267 2/1968 United Kingdom .
1106511 3/1968 United Kingdom .
1106923 3/1968 United Kingdom .
1109052 4/1968 United Kingdom .
1109158 4/1968 United Kingdom .
1182726 4/1968 United Kingdom .
1111791 5/1968 United Kingdom .
1170020 7/1968 United Kingdom .
1132103 10/1968 United Kingdom .
1117181 12/1968 United Kingdom .
1135530 12/1968 United Kingdom .
1136243 12/1968 United Kingdom .
1179229 7/1969 United Kingdom .
1239756 7/1971 United Kingdom .
1255542 12/1971 United Kingdom .
1256885 12/1971 United Kingdom .
1263248 2/1972 United Kingdom .
1268290 3/1972 United Kingdom .
1283905 8/1972 United Kingdom .
1327564 8/1973 United Kingdom .
1334230 10/1973 United Kingdom .
1353588 5/1974 United Kingdom .
1396280 6/1975 United Kingdom .
1400446 7/1975 United Kingdom .
1424195 2/1976 United Kingdom .
1467286 3/1977 United Kingdom .
1537278 12/1978 United Kingdom .
1537279 12/1978 United Kingdom .
1571884 7/1980 United Kingdom .
2085523 4/1982 United Kingdom .
US95/03078 3/1995 WIPO .

FIGURE 7 FLOWCHART

METHOD AND APPARATUS FOR CONTROLLABLY GENERATING SPARKS IN AN IGNITION SYSTEM OR THE LIKE

FIELD OF THE INVENTION

This invention relates generally to spark generation and more particularly to a method and apparatus for controllably generating and shaping sparks in an ignition system or the like.

BACKGROUND OF THE INVENTION

Solid-state ignition systems are known in the art. U.S. Pat. No. 5,065,073 and 5,245,252, the disclosures of which are hereby incorporated by reference, teach, inter alia, that improved control over the performance of an ignition system can be achieved by incorporating a solid-state switch into an ignition output circuit. As taught by these patents, the ability of a solid-state switch to be triggered at a precise time allows an ignition system incorporating such a switch to achieve controlled spark rates. It also allows such a system to generate time-varying spark sequences. In addition, as explained in the above referenced patents, since a solid-state switch can be controlled independently of the voltage level of the ignition system's tank capacitor, an ignition system incorporating a solid-state switch can be used to deliver various amounts of energy by triggering the solid-state switch when a voltage associated with a desired energy transfer appears across the tank capacitor. This later effect cannot be achieved in older circuits using spark-gap switches since such switches fire only at a single voltage which is preset during manufacture of the spark-gap switch and will, thus, fire as soon as the voltage across the tank capacitor reaches the preset triggering level.

The '073 and '252 Patents also teach the desirability of waveshaping the current delivered into an igniter plug for a sparking event. For example, these patents teach that it is desirable to deliver a current to an igniter plug which initially increases at a low rate while ionizing the plug's gap and thereafter increases at a higher rate to sustain a spark across the ionized gap. Among other things, controlling the rise time of the current in this manner maximizes the life of the solid-state switch and the igniter plug by providing such components an opportunity to pass through their transition states before being taxed with a full, high energy pulse.

As mentioned above, prior art circuits such as those disclosed in the '073 and '252 Patents have achieved some degree of control over spark generation. However, prior art circuits such as these, while achieving many beneficial effects, have been somewhat constrained in their ability to control spark generation by certain physical limitations. For example, it is well known that the energy stored in an ignition circuit employing a tank capacitor is described by the formula:

$$\text{Energy}=\tfrac{1}{2}*\text{Capacitance}*(\text{Voltage})^2$$

Thus, the energy delivered by such a circuit can be varied by changing either the charging voltage placed across the tank capacitor or the capacitance of the tank capacitor itself. There are, however, several practical limitations involved in varying these characteristics. For example, lowering the voltage levels used in the circuit requires a disproportionately large increase in the physical size of the capacitor used in the circuit to achieve similar energy levels. On the other hand, the available selection of capacitors, insulation materials, and solid-state switch components becomes limited at higher voltage levels.

The capacitance of prior art spark generating circuits is generally fixed when those circuits are constructed. In a circuit which uses a spark-gap switch the voltage is also fixed by the choice of the gap's breakdown voltage. Thus, traditional spark generating circuits are designed to deliver a predetermined energy level, but that energy level is thereafter unadjustable. In addition, prior art circuits have not attempted to control the plume shape of sparks generated at a spark generating device.

Ignition systems have been constructed for use as test apparatus wherein the user can manually vary the energy delivered by the system by physically connecting or disconnecting multiple capacitors to achieve various total capacitance and, thus, various total stored energy. However, from a safety standpoint, the high voltage and current levels in this part of the circuit makes physically switching capacitors in or out of the circuit somewhat impractical; usually requiring power-down and physical reconnection before sparking can continue. In addition, these systems have been limited to adjusting the total energy delivered and have not provided any spark shaping capabilities or real time control over the intensity and shape of the sparks generated.

OBJECTS OF THE INVENTION

It is a general object of the invention to provide an improved method and apparatus for shaping and controlling sparks. More specifically, it is an object of the invention to provide an improved method and apparatus for controllably generating sparks wherein both the energy level and the profile over time of an energy pulse used to generate sparks at a spark generating device can be electronically adjusted to suit a given application.

It is another object of the invention to provide an apparatus which electronically switches multiple discharges into a common output for the purpose of creating an ignition spark event at a spark generating device. It is a related object to provide an apparatus wherein the total energy delivered to a spark generating device is the additive contribution of multiple discharge circuits. It is a related object to provide an apparatus which more reliably generates a significantly higher total energy output pulse than prior art circuits by using multiple independent discharge circuits which individually generate relatively lower energy outputs that are combined to achieve a high energy output pulse rather than increasing the stress on a single larger energy circuit.

It is another object of the invention to provide an apparatus which can deliver a specific level of energy to a spark generating device by intentionally discharging only a subset of the multiple discharge stages. It is a related object of the invention to provide an apparatus which selectively combines the outputs of two or more discharge stages having various output energy levels to generate final output pulses having a wide range of energy levels.

It is another object to provide an apparatus which employs a binary weighting of the values of the tank capacitors of the discharge stages to provide a greater variety of possible output energies.

It is yet another object of the invention to provide an apparatus which permits a user to adjust the voltage(s) of the tank capacitors in the individual discharge stages to scale their energy levels. It is another object to provide an apparatus which permits a user to both adjust the voltage(s) of the tank capacitors in the individual discharge stages and to select which stages to trigger thereby increasing the range of possible output levels so that output pulses having virtually any energy level (zero to maximum) can be generated.

Another object of the invention is to provide an apparatus which actively waveshapes its output pulse by timing the discharging of several discharge stages so that a pattern of overlapping, partially overlapping, or non-overlapping discharges form a waveshaped pulse for generating a spark having a given plume shape. It is a related object to provide an apparatus which generates an electrical waveform that imparts various characteristics to the physical time-varying shape of the spark plume created at a spark generating device.

It is still another object of the invention to provide an ignition system which achieves better ignition by optimizing the spark plume for best transferring its energy into the fuel mixture.

Another object of the invention is to provide a spark generating apparatus whose operation enhances the life of an associated spark generating device by controlling the spark plume to reduce the arc-induced erosion of the spark electrodes. It is a related object to provide an apparatus which ionizes the gap of a spark generating device to form a plasma using a small energy pulse, and then later delivers the remainder of the energy to the plasma to complete the spark event.

It is yet another object of the invention to provide a reliable ignition source for a variety of applications which require spark ignition, including but not limited to turbine engines, piston engines, internal combustion engines, rocket engines, open or closed burners, and any other apparatus utilizing a spark ignition system. It is a related object of the invention to provide an apparatus for generating and shaping sparks for use in devices such as spacecraft thrusters where the spark itself is the primary output, or where the spark ablates a solid material or vaporizes a liquid, to provide additional thrust. In these cases conventional "ignition" of a fuel does not occur, but the benefits of the invention are still applicable.

It is still another object of the invention to provide an adjustable test apparatus which permits the generation of sparks having any desired plume shape and energy level for the purpose of determining the optimum parameters (i.e., energy level, energy distribution, three-dimensional shape, spatial intensity, and duration; any or all as a function of time, if desired) of sparks generated for a particular application.

It is a further object of the invention to provide a fixed, non-adjustable apparatus for spark generation where the energy level and plume shape of the generated sparks are fixed once the apparatus is constructed, and in which only the circuitry required to generate sparks having those particular fixed characteristics are included in the final apparatus.

Another object of the invention is to provide an apparatus for generating sparks which multiplies the energy of the output pulse by firing multiple stages simultaneously.

Another object of the invention is to provide an apparatus for actively shaping the plume of sparks generated in either high-tension or low-tension ignition systems.

It is an object of the invention to provide an apparatus which can be adapted for shaping sparks in both bipolar output systems and unipolar output systems.

It is another object of the invention to provide an apparatus for generating sparks in a plurality of spark generating devices such as in a multi-cylinder or multi-combustor engine. It is a related object to incorporate pulse steering circuitry into such an apparatus so that a single output pulse may be selectively directed to any one of a group of spark generating devices in a multiple output application. It is another related object to control multiple circuits built according to the invention using common control logic circuitry to synchronize their operation in a multiple output application.

It is another object of the invention to provide an apparatus for generating sparks at a high rate sufficient for use with multi-cylinder piston engines by sequentially firing the individual output stages in a non-overlapping manner to thereby generate sequences of closely spaced sparks, where each spark is a separate (non-additive) event.

SUMMARY OF THE INVENTION

The present invention accomplishes these objectives and overcomes the drawbacks of the prior art by providing an apparatus for controllably generating sparks which includes a spark generating device; at least two output stages connected to the spark generating device; means for charging energy storage devices in the output stages and at least partially isolating the energy storage device of each output stage from the energy storage devices of the other output stages; and, a logic circuit for selectively triggering the output stages to generate a spark. Each of the output stages includes: (1) an energy storage device to store energy; (2) a controlled switch for selectively discharging the energy storage device; and (3) a network for transferring the energy discharged by the energy storage device to the spark generating device. In accordance with one aspect of the invention, the logic circuit, which is connected to the controlled switches of the output stages, can be configured to fire the output stages at different times, in different orders, and/or in different combinations to provide the spark generating device with output pulses having substantially any desired waveshape and energy level to thereby produce a spark having substantially any desired energy level and plume shape at the spark generating device to suit any application.

In accordance with another aspect of the invention, the charging and isolating means may optionally comprise a plurality of charging circuits. In such an instance, each of the output stages can optionally be assigned a separate charging circuit for charging independently of the other output stages. Employing separate charging circuits in this manner insures that each of the energy storage devices are at least partially isolated from the other energy storage devices. The use of separate charging circuits is especially useful in applications where it is desirable to charge the energy storage devices to different voltages.

In accordance with another aspect of the invention, a method for controllably generating sparks at a spark generating device is provided. The method comprises the steps of charging a first energy storage device to a first predetermined voltage (hence, energy); charging a second energy storage device which is at least partially electrically isolated from the first energy storage device to a second predetermined voltage (hence, energy); triggering a first controlled switch associated with the first energy storage device to discharge the first energy storage device to the spark generating device at a first time in the form of an energy pulse; triggering a second controlled switch associated with the second energy storage device to discharge the second energy storage device to the spark generating device at a second time in the form of an energy pulse. In accordance with another aspect of the invention, the first and second predetermined voltages, the capacitances of the first and second energy storage devices, and the first and second times can all be adjusted to generate sparks of any desired energy distribution, three-dimensional shape, spatial intensity and duration; any or all as a function of time, if desired.

These and other features and advantages of the invention will be more readily apparent upon reading the following description of the preferred embodiment of the invention and upon reference to the accompanying drawings wherein:

DESCRIPTION OF THE PREFERRED EMBODIMENTS

Figure 1:
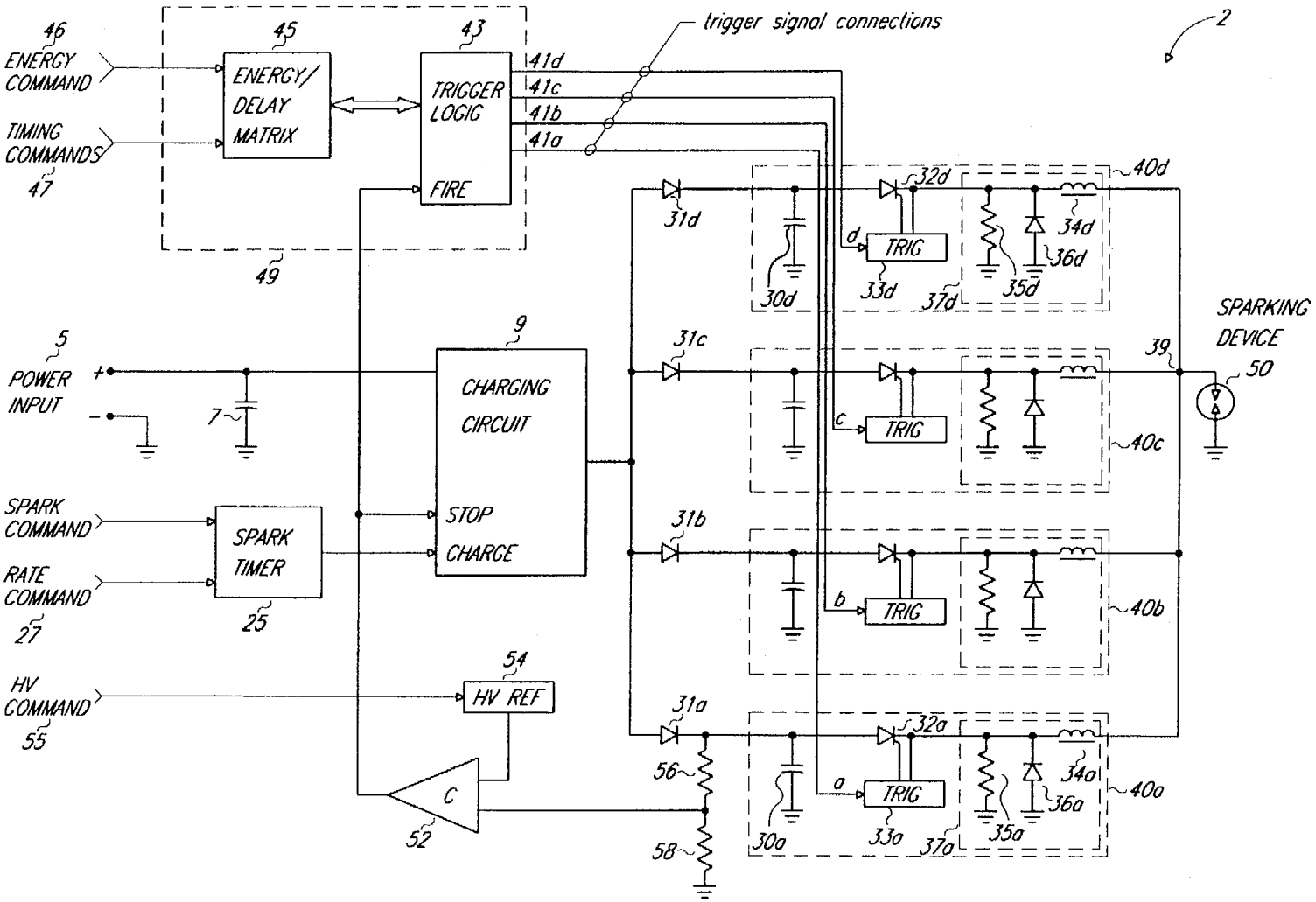
FIG. 1 is a schematic diagram of an apparatus for controllably generating sparks which is constructed in accordance with the teachings of the instant invention.

FIG. 1 shows generally a block diagram representation of a circuit 2 for controllably generating sparks constructed in accordance with the teachings of the instant invention. By varying certain input parameters as discussed below, a user can cause this circuit 2 to generate sparks having virtually any energy level and plume shape (i.e., energy distribution, three-dimensional shape, spatial intensity, and duration; any or all as a function of time, if desired). Thus, the circuit 2 is particularly well suited for use in a piece of test equipment which could be employed to determine the optimum plume shape and energy level of sparks generated for a particular application. To this end, the circuit 2 includes a spark generating device 50 for creating a spark; a plurality of independently triggerable output stages 40*a*, 40*b*, 40*c*, 40*d* connected to the spark generating device 50 for storing and selectively transferring energy thereto; and a logic circuit 49 for selectively firing one or more of the output stages 40*a*, 40*b*, 40*c*, 40*d* to create a spark of a desired plume shape and energy level at the spark generating device 50.

The spark generating device 50 can be implemented by a variety of devices, but it typically includes a set of electrodes between which a plasma forms for conducting electric current when a sufficiently high potential difference is placed across the electrodes. The spark generating device 50 can be an igniter plug or spark plug suited for the application for which a spark is being generated. In addition, the spark generating device 50 can be an assembly in which existing structural parts are used as the spark electrodes, such as in the nozzle assembly of a spacecraft thruster, or a spark rod (single electrode) in an industrial burner where the burner itself serves as the other electrode. Indeed, the possible implementations of the spark generating device are as varied as the multitude of applications for which this invention provides beneficial performance. Such applications include ignition of: all types of engines, turbines, burners, boilers, heaters, arc-lamps, strobe lamps, flarestacks, incinerators, pyrotechnic detonators, cannons, rockets, and thrusters.

Turning first to the application of power to the circuit 2, the embodiment of the invention shown in FIG. 1 includes a power input 5 which receives the electrical energy used by the output stages 40*a*, 40*b*, 40*c*, 40*d* from an external power source. The power input 5 can be used in conjunction with any source of DC power including batteries and other conventional power supplies known in the art, including rectified AC power (i.e., 120 Vac, 60 Hz. commercial power). Optionally, the power may be conditioned by an EMI (ElectroMagnetic Interference) filter (not shown) or other filtering devices if desired. Once received, the power is preferably stored locally in a capacitor 7 before it is used by a charging circuit 9.

The general purpose of the charging circuit 9 is to provide control over the charging cycles of circuit 2. In order to provide this control, the charging circuit 9 includes inputs 20, 22 for receiving two signals designated CHARGE and STOP. As their names suggest, the arrival of a CHARGE signal at input 20 causes charging circuit 9 to begin a charging cycle by providing energy in the form of an output voltage or pulses to the energy storage devices. On the other hand, the arrival of a STOP signal at input 22 causes the charging circuit 9 to terminate the charging cycle by ceasing its output.

Figure 10A:
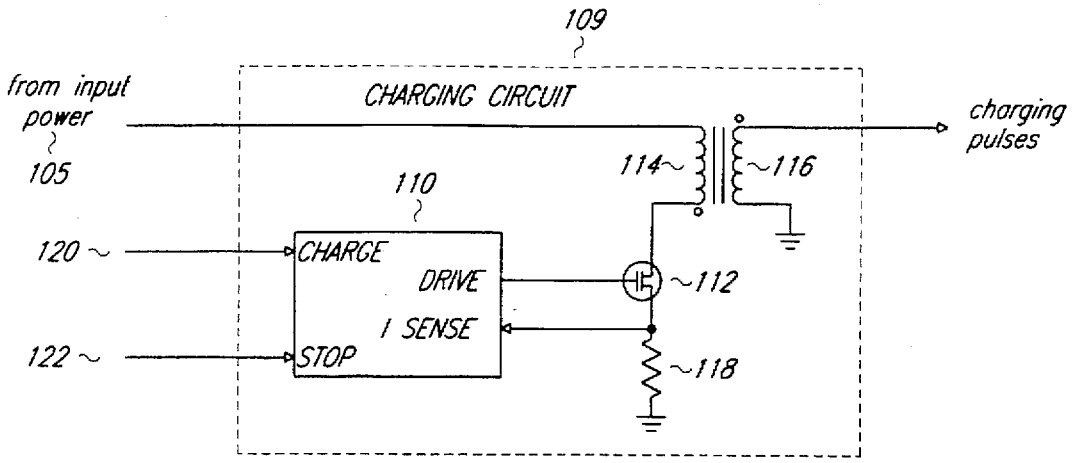
FIG. 10*a* is a schematic diagram of the preferred charging circuit.

In the preferred embodiment, the charging circuit 9 is implemented by a flyback converter such as that shown in FIG. 10*a*. However, those skilled in the art will appreciate that any type of charging circuit capable of producing a high voltage (for example, 500 to 5000 volts) or a series of high voltage pulses would also be acceptable in this role. As shown in FIG. 10*a*, the preferred charging circuit 109 includes a control circuit 110 which modulates a switching device 112 such as a MOSFET to chop the current flow through the primary winding 114 of a transformer. The chopping is usually done at a high frequency (for example, 10 to 100 kilohertz) to permit the use of a transformer of relatively small physical size. The current in the primary winding 114 is preferably monitored by a current sensing device such as current sensing resistor 118. The voltage across the current sensing device 118 provides the control circuit 110 with a feedback signal which is used in the modulation of the switching device 112. Each time the current in the primary winding 114 is interrupted (chopped), energy is transferred to the secondary winding 116 of the transformer where it emerges as a high voltage pulse in a manner known in the art. Although so called DC-to-DC converters often include a rectifier stage and an output storage capacitor or other filtering circuitry to smooth the pulses into a steady DC level, such a stage would be redundant in this embodiment since the succeeding stages perform this smoothing function as explained below.

As illustrated in FIG. 10*a*, the control circuit 110 includes two inputs 120, 122 for the CHARGE and STOP signals. The arrival of a CHARGE signal at input 120 causes the control circuit 110 to begin a charging cycle by commencing the modulation of switch 112 to thereby produce charging pulses in the secondary winding 116. This activity continues until a STOP signal is received at input 122. When such a signal is received, the control circuit 110 terminates the charging cycle by ceasing the modulation of switch 112 thereby stopping the generation of the charging pulses.

Figure 10B:
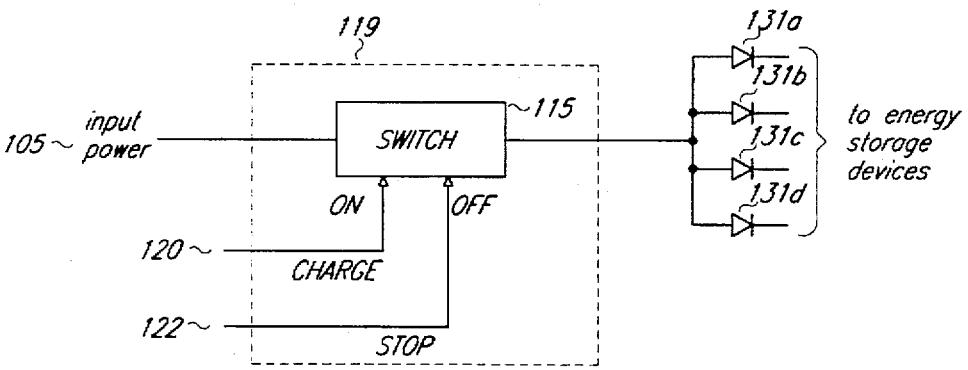
FIG. 10*b* is a schematic diagram of an alternative charging circuit.

In certain systems which have appropriate high voltage(s) available, the high voltage(s) may be applied to the power input 105 and used without any voltage conversion as shown in FIG. 10*b*. In this simpler charging circuit 119, the CHARGE 120 and STOP 122 inputs cause a switching device 115 to toggle between it conducting and non-conducting states. When in its conducting state, the switching device 115 transmits energy from power input 105 to a plurality of isolating diodes 131*a*, 131*b*, 131*c*, 131*d* which are connected to the output of charging circuit 119. When deactivated, the switching device 115 blocks transmission of energy from the power input 105, thus ceasing the charging of the energy storage devices via the diodes 131*a*, 131*b*, 131*c*, 131*d*.

Referring again to FIG. 1, the CHARGE signal is generated periodically by a spark timer 25 at a repetition rate equal to the desired sparks-per-second rate. This rate may be adjustable in which case a rate command 27 input by a user would establish the setpoint, or it may be fixed by the circuit values depending on the intended use of the device. In another alternative implementation, the spark timer 25 is provided with a rate command 27 which automatically changes from a higher to a lower rate at a certain time after sparking first commences. This burst-of-sparks mode is fully described in U.S. Pat. No. 5,399,942, the disclosure of which is hereby incorporated by reference.

Preferably, the spark timer 25 includes an input for receiving a spark command 29 which, together with the rate command 27, provides several possible operating modes. In a first mode, the spark command 29 is synonymous with the application of power so that sparking commences immediately when the power input 5 receives power, and ceases when that power is removed. In a second mode, the spark command 29 is an external input as shown in FIG. 1 which permits an operator of the apparatus to decide when to commence or cease sparking while the power at power input 5 is maintained. In a third mode, the rate command 27 is set to a repetition rate of zero so that each individual spark command 29 causes a single spark.

Upon receiving a CHARGE signal the charging circuit 9 provides a charging voltage which is transmitted via isolating diodes 31*a*, 31*b*, 31*c*, 31*d* to the inputs of the plurality of output stages 40*a*, 40*b*, 40*c*, 40*d*. These output stages 40*a*, 40*b*, 40*c*, 40*d* are substantially structurally identical in this embodiment. They each include: an energy storage device 30*a*, 30*b*, 30*c*, 30*d*; a controlled switch 32*a*, 32*b*, 32*c*, 32*d* with an associated triggering circuit 33*a*, 33*b*, 33*c*, 33*d*; and a network 37*a*, 37*b*, 37*c*, 37*d*. In view of these similarities, and in the interest of simplicity, the following discussion will use a reference numeral in brackets without a letter to designate an entire group of substantially identical structures. For example, the reference numeral [30] will be used when generically referring to capacitors 30*a*, 30*b*, 30*c* and 30*d* rather than reciting all four reference numerals.

It should be noted that, although for simplicity the output stages [40] have been described as substantially identical in this embodiment, as explained in further detail below, the capacitance value(s) of one or more of the individual energy storage devices [30], as well as the voltage(s) these devices [30] are charged to, can be varied from one another to permit the circuit 2 to produce sparks having a greater range of plume shapes and/or energy levels without departing from the scope or the spirit of the invention. Indeed, in many applications, employing capacitors having different capacitance values as the energy storage devices [40] is preferred. Several approaches to selecting these capacitance values are described in detail below.

As shown in FIG. 1, the storage capacitors [30] are charged by energy emanating from the output of the charging circuit 9 via the isolating diodes [31]. These diodes [31] perform three distinct functions. First, when necessary, they rectify the pulsed output of certain converters such as the flyback converter shown in FIG. 10*a* to provide pulses of only one polarity so that each successive pulse incrementally charges the capacitors [30]. Second, the diodes [31] prevent the energy stored in the capacitors [30] from leaking back through the charging circuit 9. Finally, the diodes [31] isolate the capacitors [30] from one another. Without the diodes [31], the capacitors [30] would be in parallel electrically and would, therefore, represent the equivalent of a single larger capacitance having a value equal to the sum of the individual parallel capacitances. In such a case, discharging one of these parallel capacitors would have the effect of discharging them all. In the preferred embodiment, however, the multiple diodes [31] allow all of the capacitors [30] to be charged from the same charging circuit 9, and further permit each of the capacitors [30] to be discharged individually via the controlled switches [32] without affecting the charge of the others. Thus, if only a particular switch (such as 32*a*) discharges its associated capacitor (i.e., 30*a*) the remaining capacitors (i.e., 30*b*, 30*c*, 30*d*) will remain charged; ideally until such time that their respective switches (i.e., 32*b*, 32*c* & 32*d*) are triggered.

Although the direction (polarity) of the diodes [31] produces a positive charge on the capacitors [30], it will be appreciated by those skilled in the art that the polarity of the diodes [31], the switches [32], and the other associated components can be reversed to produce a negative charge and correspondingly negative output pulse without departing from the scope or the spirit of the invention.

The controlled switches [32] are preferably silicon controlled rectifiers (commonly referred to as SCR's or thyristors). However, it will be appreciated by those skilled in the art that other controlled switching devices which are capable of operating at the voltage and current levels generally associated with spark generating may be substituted for the SCR devices without departing from the scope or the spirit of the invention. In this regard, it should be noted that the switching device does not need to be a solid-state (semiconductor) device. Instead, it need only be triggerable by the control circuits. Thus, certain other triggerable spark-gap switches, other types of semiconductor devices such as MOSFETs or MCTs (Mos Controlled Thyristors), and electromechanical switches such as relays can all be appropriately employed as the controlled switches [32] without departing from the scope of the invention. It should also be noted that, although an exemplary triggering circuit and technique is described below, other triggering methods employing electrical, optical, magnetic, or other signals appropriate to the device chosen for the controlled switch can be used in this role without departing from the scope or the spirit of the invention.

Figure 2:
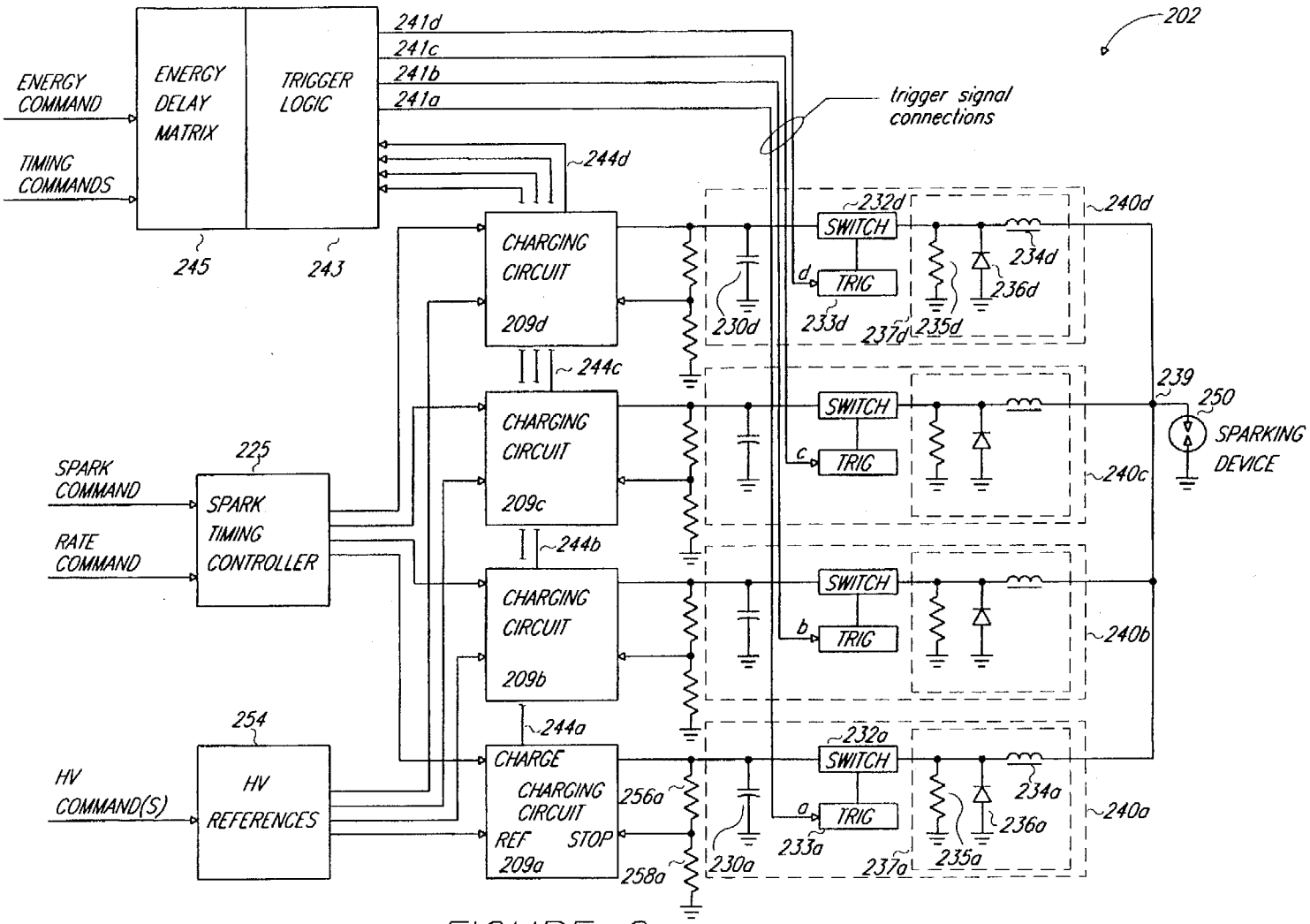
FIG. 2 is a schematic diagram similar to FIG. 1 but showing an alternative embodiment of the invention which employs multiple charging circuits to charge the individual output stages of the spark generating circuit.

In the alternative embodiment illustrated in FIG. 2, a plurality of charging circuits [209] similar to charging circuit 9 is used to charge the capacitors [230] of the output stages [240] independently of one another. This alternative approach offers several advantages over the single charging circuit embodiment shown in FIG. 1. For example, it permits the circuit to generate a greater range of output waveforms having a greater range of total energy levels and waveshapes. More specifically, the use of separate charging circuits enables each capacitor [230] to be charged to a different voltage such that each output stage [240] has a different level of stored energy. Consequently, each stage will transfer a particular amount of energy (i.e., dependent on both its stored voltage and its capacitance) to the spark generating device 50 when fired. A user can then elect to fire one or more of the stages [240] in combination to arrive at a desired output. Another advantage of this approach is that, instead of taxing a single charging circuit, the work associated with charging the capacitors is divided among a plurality of charging circuits [209]. Such an approach results in greater power throughput than can typically be achieved using a single charging circuit (unless simple charging circuits similar to that illustrated in FIG. 10*b* are employed as the plurality of charging circuits).

Finally, this approach permits the exclusion of the isolating diodes [31] since the separate charging circuits serve as a means for charging the energy storage devices and at least partially isolating each of the energy storage devices from the energy storage devices in the other output stages. In the single charging circuit embodiments, the charging circuit and the isolating diodes combine to form a means for charging the energy storage devices and at least partially isolating each of the energy storage elements from the energy storage elements of the other output stages.

Although the embodiment of FIG. 2 assigns one charging circuit to every capacitor, those skilled in the art will appreciate that any other combination of charging circuits and capacitors can be used without departing from the scope or the spirit of the invention. For example, one could divide the stages [240] into groups of two and assign each group a single charging circuit without departing from the invention. In addition, those skilled in the art will appreciate that the charging circuits can be configured to produce either different output voltages or identical output voltages without departing from the scope or the spirit of the invention.

Figure 10C:
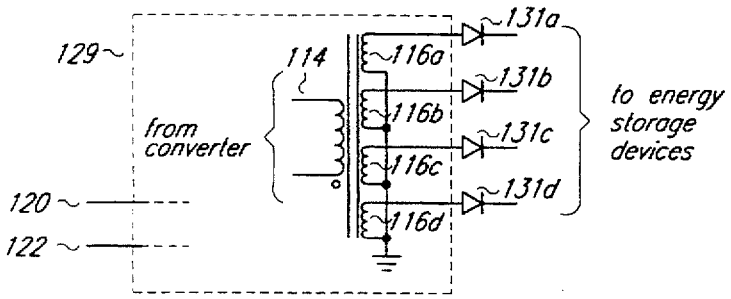
FIG. 10*c* is a schematic of another alternative charging circuit which, among other things, isolates the energy storage devices of the output stages from one another.

Some of the benefits of employing separate charging circuits as shown in FIG. 2 can be realized by employing the less complex charging circuit 129 shown in FIG. 10*c*. In this circuit multiple secondary windings [116] on the converter transformer separately provide isolated charging pulses to the output stages. Because the windings [116] are separate, they can be constructed to generate the same or different charging voltages. The rectifier diodes [131] in FIG. 10*c*, although located in a similar position as the isolating diodes in other figures, are used principally as rectifiers of the AC output pulses characteristic of converter circuits, since the isolation function is accomplished by the separate windings [116]. It will be appreciated by one skilled in the art that the multiple windings [116] could comprise a single winding with multiple taps, thus providing the different voltages. However, in such an approach, the windings would not isolate the output stages from one another and the isolating diodes would, therefore, be needed in this isolation role.

Returning to the embodiment illustrated in FIG. 1, the description of any one of the plurality of output stages [40] included in this embodiment will serve for all since, as explained above, these stages [40] are substantially structurally identical. Specifically, each of the output stages [40] includes: an energy storage element [30], a controlled switch [32], and an output network [37]. The operation of such a circuit is described in detail in U.S. Pat. No. 5,245,252 which has been incorporated herein by reference. Thus, the construction and operation of the circuits [40] will only be described briefly here. The interested reader is referred to the '252 Patent for a more detailed description.

As mentioned above, the energy storage elements [30], which are preferably capacitors, are charged by the charging circuit 9 via isolating diodes [31]. At any time after the capacitors [30] have reached their prescribed levels of charge, the logic circuit 49 can selectively discharge any of these devices by triggering the appropriate controlled switch [32]. To this end, the trigger logic 43 is coupled to the output stages [40] via four separate trigger signal connections [41]. It will be understood that four separate connections [41] are preferably employed, although a single communication line with appropriate multiplexing circuitry could be employed in this capacity if desired, as could indirect coupling (for example, the use of fiber-optic links), without departing from the scope or the spirit of the invention.

In any event, the trigger signal connections [41] couple the trigger logic 43 to a trigger circuit [33] in each of the output stages [40]. These trigger circuits [33] are each equipped to open and close their associated controlled switch [32] in response to a trigger signal from the trigger logic 43.

The trigger circuits [33] may contain a variety of circuitry depending on the specific component used to implement the controlled switches [32]. Preferably, they include isolation components which protect the lower-voltage logic circuits 49 from the higher voltages present at the switches [32]. In the preferred embodiment, which uses SCR's as the controlled switches [32], a pulse (trigger) transformer with associated drive circuitry known in the art is employed as the trigger circuit [33]. The secondary winding of this transformer is connected to the gate and cathode terminals of its assigned SCR, and its primary winding is connected to the trigger signal connection [41]. The trigger logic 43 can then energize the transformer via a control signal which induces a current in the secondary winding of the transformer that is sufficient to transition the SCR to a conducting state.

When activated in this manner, the controlled switch [32] transitions from its off (non-conducting) state to its on (conducting) state. This allows the energy stored in capacitor [30] to flow through the network [37] to the output of circuit [40] where it is delivered to a sparking device 50 to create an ignition spark. Since the outputs of all of the output stages [40] are connected to the sparking device 50 via junction 39, the energy delivered to the sparking device 50 will be the overlapping, partially overlapping, or non-overlapping summation of the energies delivered by each triggered output circuit [40] depending on the timing of their firing.

It should be noted that, although for clarity only a single device has been shown to represent the controlled switch, as taught in the previously referenced '252 patent, the controlled switch [32] may comprise a group of devices triggered simultaneously as if they were a single device without departing from the scope or the spirit of the invention.

Each network [37] in the preferred embodiment consists of three components: an inductance [34] (preferably a saturable core inductor as disclosed in the '252 Patent) connected so that the current must pass through it on its way to, or from, the sparking device 50; a resistor [35]; and an optional unipolarity diode [36] connected to ensure a nominally unidirectional discharge current to the spark generating device 50 if a unipolar ignition is desired. The networks [37] of the output stages [40] perform several important functions. First, they waveshape the voltage and current of the output waveforms to improve ignition. Second, they provide protection for the solid-state switch [32] in the circuit by holding off the current discharged from the capacitor [30] for a time sufficient for the switch [32] to transition from its non-conducting state to its conducting state. These functions are described in detail in U.S. Pat. No. 5,245,252 and will not be described in further detail here.

In the instant invention, the networks [37] have a third purpose. Specifically, since all of the networks [37] are connected to the spark generating device 50 via junction 39, the networks [37] must also provide a degree of reverse isolation so that the discharge of one stage does not inadvertently false-trigger any of the other stages. Whenever one or more of the output stages [40] is discharged, the junction 39 where all of the stages [40] connect together with the sparking device 50 is subjected to large voltage transients. For example, when one of the switches [32] is closed, the junction 39 is driven to the voltage previously stored in the tank capacitor [30]. Then, at the instant the spark plasma forms with its extremely low resistance, the junction 39 is driven back toward ground (zero volts). This transient pulse would impress a large dv/dt stress on the untriggered switches [32] if the network [37] were not present to isolate the switches [32] from the junction 39. With the network [37] in place, the values of the inductance [34] and resistance [35] can be chosen to act as a low-pass filter, thus preventing the high dv/dt transient pulse at the node 39 from reaching the untriggered switches [32].

Those skilled in the art will appreciate that the inductor [34] may be located elsewhere (for example, in the ground return path) so long as the discharge current passes through it as well as through the spark generating device 50.

Those skilled in the art will further appreciate that many arrangements of output networks which produce a similar isolating result could be employed without departing from the scope or the spirit of the invention. For example, in the alternative embodiment illustrated in FIG. 3, the networks [337] each include a diode [300] which permits energy to flow from any stage [340] through the junction 339 and to the sparking device 350. However, the diodes [300] also prevent reverse energy from transferring back from the junction 339 into the output stages [340]. The use of diodes [300] to isolate the outputs of the stages [340] is similar conceptually to the use of diodes [31] to isolate the inputs of the stages [40] that was described earlier with reference to FIG. 1. There is, however, an important difference between the two implementations. Specifically, the magnitude of the current carried by the diodes [31], [331] at the inputs of the discharge stages [40], [340] is relatively small compared to the currents carried by the output diodes [300]. For instance, the output currents are typically on the order of several hundred to thousands of Amperes whereas the input currents are usually on the order of tens to hundreds of milliAmperes. Electrical losses in an imperfect diode are proportional to the current it passes. Therefore, while the diodes [300] incorporated into the output networks [337] of the device would provide good reverse isolation, they are inefficient when used to carry current of large magnitude and would rob part of the discharge energy. Also, inclusion of a diode in the manner illustrated by FIG. 3 restricts the circuit to unipolar operation. As a result of these limitations, this isolation technique is not preferred.

Figure 3:
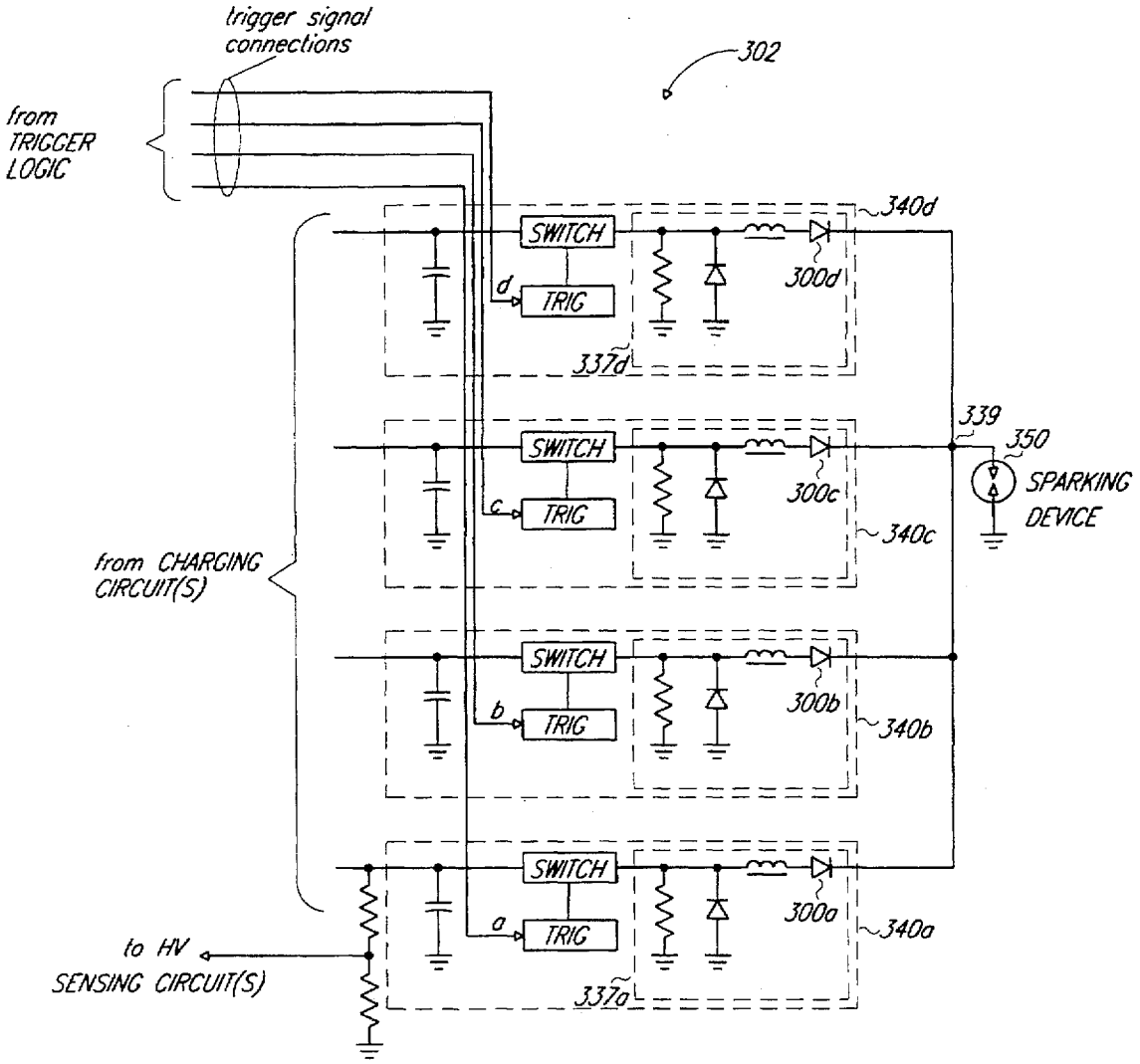
FIG. 3 is a schematic diagram of another alternative embodiment of the invention similar to FIG. 1 but illustrating the use of diodes to combine the stages to provide a single output to a spark generating device while electrically isolating the individual output stages from each other.

In the embodiment shown in FIG. 3, the diodes [300], as shown, are all connected to junction 339. However, as those skilled in the art will appreciate, the networks [337] could be modified to perform substantially the same function by reversing the positions of each inductor [336] and its series-connected diode [300] without departing from the scope or the spirit of the invention.

Figure 4:
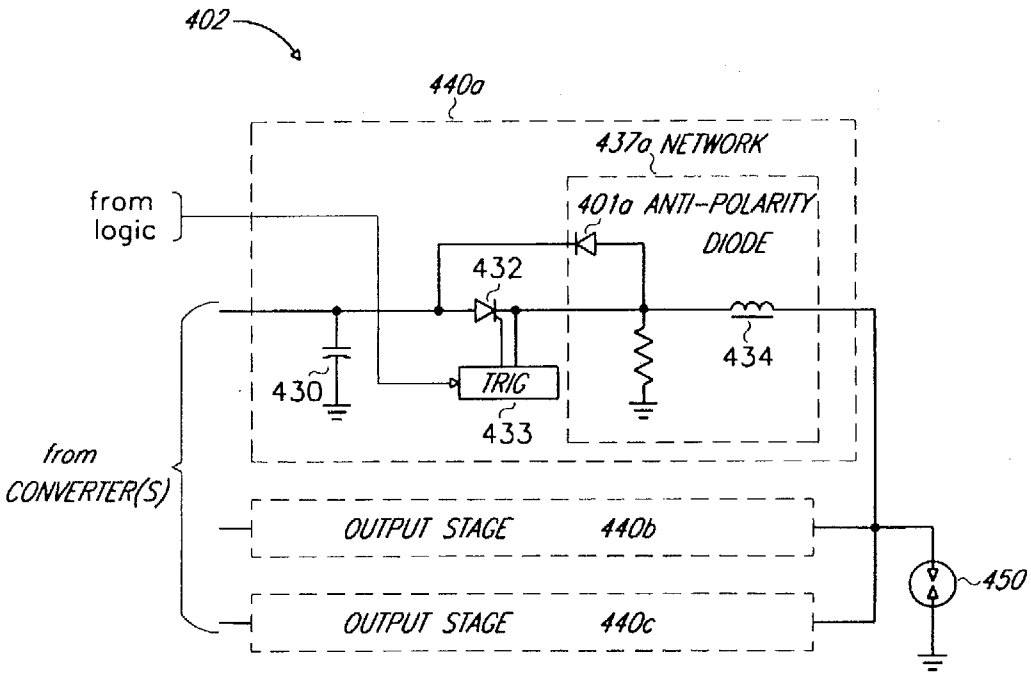
FIG. 4 is a schematic diagram of another alternative embodiment of the invention similar to FIG. 1 but which is particularly adapted to produce a bipolar output.

Certain ignition applications may require modifications to the embodiment shown in FIG. 1. For example, if a bipolar ignition is desired, the networks [437] of the output stages [440] could be modified as shown in FIG. 4. It should be noted that although for simplicity FIG. 4 only illustrates one of the output stages 440*a* in detail, the other output stages 440*b*, 440*c* would be similarly constructed. In addition, it should be noted that FIG. 4 illustrates an embodiment of the invention having only three output stages [440]. However, like all of the other embodiments of the invention, it could be constructed with any other multiple number of stages (i.e., at least two) without departing from the scope or the spirit of the invention.

The bipolar circuit 402 illustrated in FIG. 4 does not include the unipolarity diode [36] that was used in the unipolar circuit of FIG. 1 because in bipolar ignition systems the current through the spark generating device 450 reverses direction for a substantial portion of the energy delivery cycle. In both the bipolar and unipolar systems, the current transfers the energy in the capacitor [430] to the spark generating device 450 via the inductor [434]. However, not all of the energy is dissipated in the first portion of the discharge cycle. Some of the energy remains in the inductor [434]. In a unipolar circuit such as that shown in FIG. 1, this energy would ultimately be discharged from the inductor [34] in a later part of the discharge cycle via the freewheeling diode [36] with the current discharging in the same direction through the spark generating device 50 throughout the cycle. In bipolar circuits such as that shown in FIG. 4, the second part of the cycle is characterized by a reversal of the current flow by which a portion of the energy in the inductor [434] is transferred back to the capacitor [430] with most of the remaining energy being consumed by the spark generating device 450. The residual, unconsumed energy continues to oscillate back and forth between the inductor [434] and the capacitor [430] with each surge supplying additional energy to the spark plasma until the energy is dissipated.

Such oscillations should not be confused with short duration oscillatory transients which are typically present in circuits. Although such "noise" transients appear to have high magnitude, they do not transfer significant useful energy to the plasma. Noise transients such as these appear in many circuits including circuits designed to be substantially unipolar. Although these transient noise pulses may be bipolar, the circuit is still a "unipolar circuit" as long as the main energy transfer is a substantially unipolar event.

An anti-polarity diode [401] is a necessary part of the network [437] when certain semiconductor switching devices [432] are used. Such a diode [401] permits the reversed current to flow, but bypasses the switch [432] so that the switch is not damaged by a reverse current flow through it. In these embodiments, the trigger circuit [433] must ensure that the controlled switch [432] remains conductive throughout the several cycles which include reversals of current.

Figure 5A:
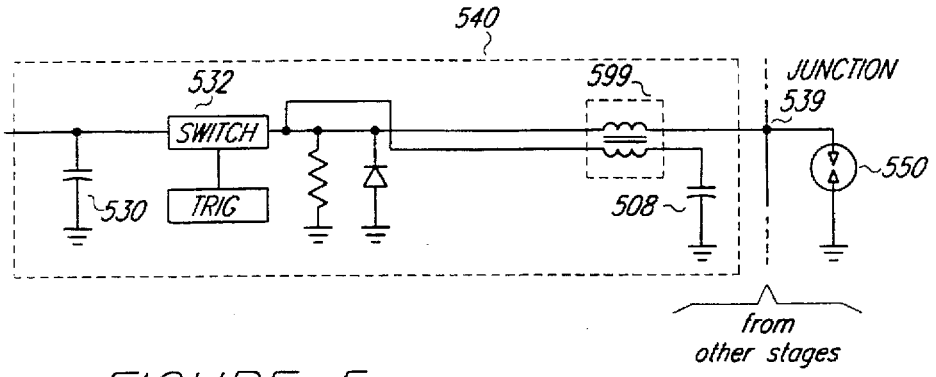
FIG. 5*a* is a schematic diagram of an alternative configuration of an output stage adapted to provide a high-tension ionizing pulse at the beginning of a spark event.

In high-tension ignition embodiments, the spark generating device has a breakdown voltage (the minimum voltage for the plasma to form) which is generally beyond the practical limits of the switching device, capacitor, and other components of the individual output stages [40]. To overcome this difficulty, these systems may employ a special inductor/transformer 599 in one or more of the networks of their output stages as shown in FIG. 5*a*. A first winding of this device 599 is preferably connected in series arrangement (end-to-end, in any order) with the capacitor 530, switch 532, and spark generating device 550 in a similar position as the inductor [34] of FIG. 1. A second winding of the inductor/transformer 599 is magnetically coupled to the first winding for transferring a voltage pulse thereto when the controlled switch 532 is triggered. Thus, when the switch 532 is triggered, a transient pulse across the second winding creates a voltage across the first winding which is additive with the voltage already impressed upon that first winding by the closure of the switch 532. Although the exact value of this voltage depends on the turns-ratio of the first and second windings, their combined voltage can have a magnitude of several to tens of times greater than the energy storage voltage provided by the capacitor 530 alone. While the additive effect of the pulse through the secondary winding is generally of a short duration relative to the overall discharge event, (a limiting device 508, which is preferably a small capacitor, is usually employed in series with the second winding to limit the pulse to a short transient which consumes only a small percentage of the energy that was stored in capacitor 530), the increased voltage at the initiation of the discharge event is sufficient to create a plasma in a high-tension spark generating device 550. After this plasma is formed, the resistance between the electrodes becomes negligible and the main discharge current then flows through the series-connected first winding which acts in the same manner as the series output inductor described above in connection with FIG. 1 without further assistance from the second winding.

Those skilled in the art will appreciate that the exact placement and polarity of the connections of the inductor/transformer 599 is not critical so long as the additive effect creates an ionizing pulse of sufficient positive or negative polarity to cause the plasma to form at the high-tension spark generating device 550. Furthermore, like the ionization pulse, the post-ionization discharge current (i.e., the current following the initial ionizing pulse) may be either bipolar or substantially unipolar. In the case of a substantially unipolar post-ionization discharge current, the circuit is referred to as a "unipolar circuit", and the presence of a bipolar ionizing pulse or an ionizing pulse having a polarity opposite to that of the post-ionization discharge current does not change this definition. In other words, for purposes of this application, a circuit is defined to be unipolar even if the polarity of the current discharging through the spark generating device is opposite to the polarity of the ionization pulse and/or even if the ionization pulse itself is bipolar as long as the post-ionization discharge current flows substantially in one direction.

Figure 5B:
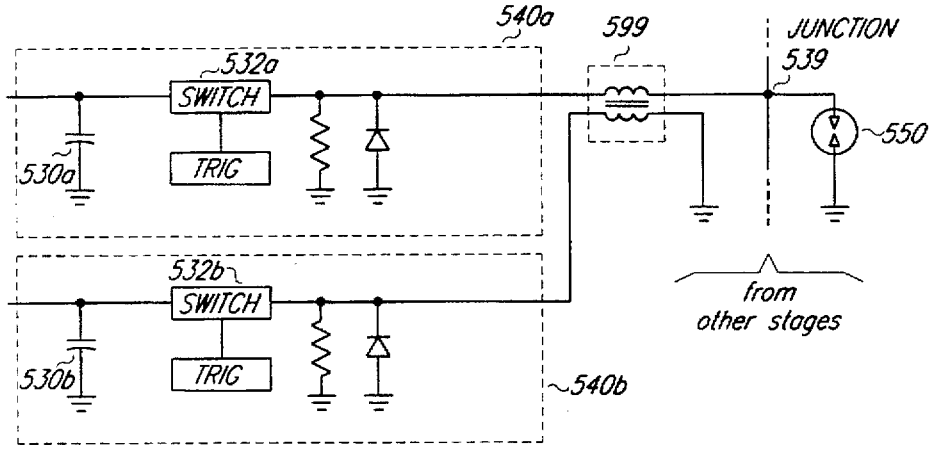
FIG. 5*b* is a schematic diagram of another alternative configuration of the output stages similar to FIG. 5*a* but where the high-tension ionizing pulse is generated by the output of a second stage.

In a related embodiment illustrated in FIG. 5*b*, the current through the second winding of the inductor/transformer 599 is driven and controlled by one of the other output stages 540*b*. The inductor/transformer 599 thus serves to combine the energies discharged by the two stages 540*a*/540*b* into a common output. As will be appreciated by those skilled in the art, the inductors [534] of the other stages [540] can be combined into the output by connecting them to junction 539 or, alternatively, they can be added to the inductor/transformer 599 as additional windings in order to combine the energies of these additional stages with the stages illustrated in FIG. 5*b* without departing from the scope or the spirit of the invention.

Figure 5C:
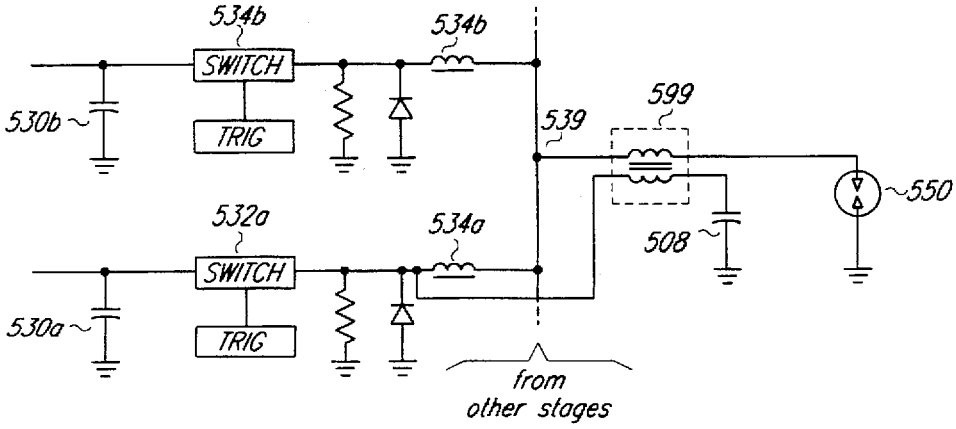
FIG. 5*c* is a schematic diagram of yet another alternative configuration of the output stages similar to the other illustrated configurations but including a separate inductor/transformer to supplement the combined outputs of the individual output stages with a transient high-tension pulse.

In another related embodiment illustrated in FIG. 5*c*, the high-tension inductor/transformer 599 is a separate device (not replacing any inductor [534]) which is connected so that low-tension pulses at junction 539 will have a transient high-tension ionizing pulse added to them for the purpose of ionizing the gap of the spark generating device 550 to create a plasma.

The embodiments shown in FIGS. 5*a*, 5*b*, and 5*c* are configured as unipolar circuits. Alternatively, these embodiments could be configured as bipolar circuits, for example, by modifying the circuits as taught above in reference to FIG. 4.

Generally, the plurality of stages may be configured to have any combination of constructions. For example, one stage could be configured as a bipolar circuit while a different stage could be configured as substantially unipolar. Similarly, another stage could be configured as high-tension and yet another configured as low-tension. All of these stages acting together produce the ultimate waveshape which reaches the spark generating device. Furthermore, the controlled relative timing of the discharges in circuits combining these techniques (i.e., bipolar, unipolar, high-tension, and low-tension pulse generation) in any combination adds yet another degree of complexity to the waveshape of the pulse supplied to the spark generating device and, thus, to the time-varying plume shape of the sparks generated.

Turning again to FIG. 1, the output circuits [40] are, in large part, controlled by two main elements: a voltage sensing comparator 52 and the logic circuit 49. These elements 52, 49 combine with the above mentioned spark timer 25 to achieve total control of the spark generation. More specifically, after the spark timer 25 requests the next spark event by activating the charging circuit 9, the comparator 52 begins to continuously monitor a signal taken from a voltage divider network consisting of resistors 56 and 58. This signal is proportional to the voltage appearing across the energy storage capacitors [30]. The comparator 52 compares this proportional signal with a reference voltage received from the HV reference 54 to determine when the capacitors [30] have reached a predetermined voltage.

Although in the embodiment illustrated in FIG. 1, a voltage divider and voltage-sensing comparator is employed to monitor the voltage of the capacitors [30], those skilled in the art will appreciate that other structures for indirectly or directly monitoring the voltage across the capacitors [30] such as structures which measure the charge time in a circuit that charges the capacitors [30] at a constant rate could be employed without departing from the scope or the spirit of the invention.

When the capacitors [30] reach their desired charge, the voltage produced by the voltage divider will equal the voltage appearing at the HV reference 54. At that instant, the comparator 52 will switch its output to signal the event to the other circuit blocks. One destination of the signal generated by the comparator 52 is the STOP input 22 of the charging circuit 9. When the charging circuit 9 receives this signal, it stops charging the capacitors [30]. Thus, the energy stored by the capacitors [30] is closely controlled. In the embodiment illustrated in FIG. 1, an input 55 allows the operator to input a HV command to preset the exact charge voltage of the capacitors [30]. In some production apparatus, this input 55 may be omitted and the voltage value fixed so that all sparks are delivered at the same optimum voltage without the user's involvement.

In the embodiment illustrated in FIG. 1, the above described voltage control is accomplished by monitoring only one of the plurality of output stages [40] since all of the capacitors [30] are charged to the same voltage. When capacitors of varying sizes are employed, it has proven advantageous to monitor the smallest of the capacitors [30] because its voltage changes more rapidly than the voltages of the other capacitors (i.e., it has the fastest electrical time constant). Many more complicated circuits can be constructed to monitor more than one of the output stages. For example, it may be useful to select the highest of a plurality of monitored voltages for use as the feedback signal.

In other embodiments such as that shown in FIG. 2, a plurality of charging circuits [209] is employed; with each such charging circuit [209] having an assigned storage capacitor [230]. In this embodiment, a voltage sensing network is provided in each stage [240] to permit each charging circuit [209] to separately monitor the charging of its assigned capacitor [230]. Each charging circuit [209] in FIG. 2 includes a comparator (not shown) similar to the comparator 52 illustrated in FIG. 1 or other equivalent circuitry which stops the charging (similar to the STOP signal 22 of FIG. 1) and provides an individual FIRE signal 244*a*, 244*b*, 244*c*, 244*d* to the trigger logic 243.

The single point monitoring illustrated in FIG. 1 is advantageous only from a circuit simplicity and expense standpoint, and can only be used in embodiments where all of the capacitors [30] are charged to the same voltage.

The second destination of the signal generated by comparator 52 is the logic circuit 49. As shown in FIG. 1, this signal is received at the FIRE input 44 of the trigger logic 43 which tells the circuit that the desired energy storage level has been accomplished and that the output stages [40] are, thus, ready for firing. In the preferred embodiment, the trigger logic 43 triggers the stages [40] by sending trigger signals down the appropriate trigger signal connections [41] in accordance with rules stored in the energy/delay matrix 45. These rules determine whether each individual stage is fired at all, and when, relative to the firing of the first stage, they will each be fired. Thus, depending on the rules stored in the energy/delay matrix 45, the trigger logic 43 will trigger one or more of the output stages [40] to transfer an overlapping, partially-overlapping, or non-overlapping output waveshape or pulse to the spark generating device 50. The spark generating device 50 will then produce a spark whose time-varying plume shape and energy level will correlate to the waveshape and energy level of the received pulse.

It should be noted that, for purposes of this patent application, "plume shape" refers to a single charging/discharging cycle. Thus, if the apparatus is configured to produce a sequence of two or more sparks within a single charging/discharging cycle, it still produces a single plume shape for that cycle (i.e., a plume shape with at least one instant of zero energy between the inception and termination of ionization at the spark generating device during a given charging/discharging cycle). Of course, it also produces a single plume shape if it produces a single spark during a given charging/discharging cycle (i.e., with no instants of zero energy between the initiation and termination of ionization at the spark generating device during a given charging/discharging cycle).

The energy/delay matrix 45 may be preset, or it may receive either or both an ENERGY command 46 and a TIMING command 47 from an operator of the apparatus. The ENERGY command 46 controls the total energy which will be transferred to the spark generating device 50 by determining which of the stages [40] will be fired in combination to produce the requisite summation equaling the desired total energy. The energy/delay matrix 45 can be configured in the form of a look-up table. Thus, for any energy level a user might request, the energy/delay matrix 45 would have a corresponding setpoint that indicates which stages [40] should be fired to achieve the desired result. The energy/delay matrix 45 could also be used to store data indicating the voltage(s) the stages [40], [140] should be charged to. Of course, the energy/delay matrix 45 can be so configured in any embodiment of the invention.

Finally, after all selected output stages have been triggered, the circuit rests before the spark timer 25 initiates the next cycle. The interval between spark cycles, which commences upon the completion of the discharge of the slowest-discharging stage, must be long enough to permit the controlled switches [32] to transition fully to their non-conductive states before the next charging cycle begins.

In the preferred embodiment, the capacitance values of the energy storage devices [30] of the output stages [40] are binary weighted to permit the device to generate pulses having a wide range of output energies. (Those skilled in the art will, however, appreciate that this same weighting effect could be achieved by using identical capacitors charged to different voltages in accordance with the above-described techniques.) Thus, the stages [40] are given the relative energy scaling 1:2:4:8. In other words, if the smallest of the stages has an energy of 1 (one) unit, then the other stages have 2 (two) units, 4 (four) units, and 8 (eight) units of energy, respectively. This weighting permits the device to generate a pulse having any energy level between 0 and 15 units (16 distinct levels) by firing various combinations of the stages [40]. For example, firing only the 1 unit and 4 unit stages produces the sum: 1+4=5 units. It should be noted that the scaling unit is not necessarily 1 Joule. Instead, the scaling system is equally useful regardless of the base unit chosen. For example, if the base unit has a value of ½ Joule, then firing the above combination of stages [40] would produce an output pulse having:

$$\tfrac{1}{2}*(1+4)=2.5 \text{ Joules}$$

of total energy. Thus, the energy of the pulse generated by the apparatus equals the base unit multiplied by the collective sum of the scaling factors of the stages fired. The maximum energy of this four stage embodiment is then:

$$\text{UNIT VALUE}*(1+2+4+8)=\text{UNIT VALUE}*15$$

In actual practice, there may be other limitations which necessitate deviation from the optimal binary weighting of the stages. In one implementation of the invention that has been tested, the smallest stage was designed to store and fire 1.0 Joule of energy. In combination with two other stages designed to fire 2.0 and 4.0 Joules of energy, respectively, an apparatus was constructed which generated pulses having up to (1.0+2.0+4.0)=7.0 Joules of total energy. In order to produce a higher maximum output a fourth stage was needed, but following the binary weighting rule would require a single stage capable of generating 8.0 Joules of energy. This level of energy was beyond the practical limitations of the exact components which had been used to construct the other three stages. Thus, a capacitor capable of storing 5.0 Joules of energy was selected for the fourth stage and the final device generated sparks having a maximum total energy of:

1.0*(1+2+4+5)=12.0 Joules

While this is a useful result, it is not optimal because this system could only produce pulses having 13 distinct energy levels (0 through 12) whereas a true binary weighting system could produce pulses having 16 distinct levels of energy. The loss of 3 possible energy levels is due to redundancies in the sequence. Specifically, three energy levels can be achieved by firing either of two different combinations of stages that sum to the same total value:

level 5 is either (5) or (1+4)

level 6 is either (1+5) or (2+4)

level 7 is either (1+2+4) or (2+5)

Thus, while there are still 16 possible combinations, only 13 of those combinations produce distinct energy levels. Those skilled in the art will recognize that the above exemplary device could be modified to perform in accordance with a true binary weighting system by replacing the five Joule stage with two 4.0 Joule sub-stages which are fired simultaneously to discharge 8.0 Joules of energy.

The other input to the energy/delay matrix 45 is the TIMING command input 47. This command controls the timing and order for triggering the various output stages [40]. The timing sequence begins anew each time the FIRE input 44 of the trigger logic 43 receives a signal from the comparator 52. In the preferred embodiment, the trigger logic 43 relies on data stored in the energy/delay matrix 45 to generate each of the plurality of trigger signals after a delay specific to the corresponding stage stored in the matrix 45 has passed. The actual generation of the trigger signal occurs if, and only if, that stage is active according to the ENERGY command that was last stored in the matrix 45.

In the embodiment shown in FIG. 1, the TIMING commands may be thought of as four separate delay commands corresponding to the four individual stages [40] shown in the figure. If the number of stages is less or more than four, then the number of delay commands corresponds to that number of stages. In certain production apparatus there may not be a delay function, in which case the trigger logic 43 delivers trigger signals simultaneously to whichever stages are to be fired.

The magnitude of the delay for any stage [40] ranges from zero to a practical maximum which is determined by the self-discharge time of the apparatus of FIG. 1. At the same instant that the trigger logic 43 receives the FIRE signal, the charging circuit 9 receives its STOP signal and ceases charging the capacitors [30]. In the preferred embodiment, any stage which is not triggered at this time begins a relatively slow self-discharge of its stored energy due primarily to leakage through the less-than-perfect controlled switch [32] and resistor [35]. After some amount of time determined by the component values, the capacitor [30] loses its useful energy, and a trigger signal occurring after that time would have little effect.

Figure 6:
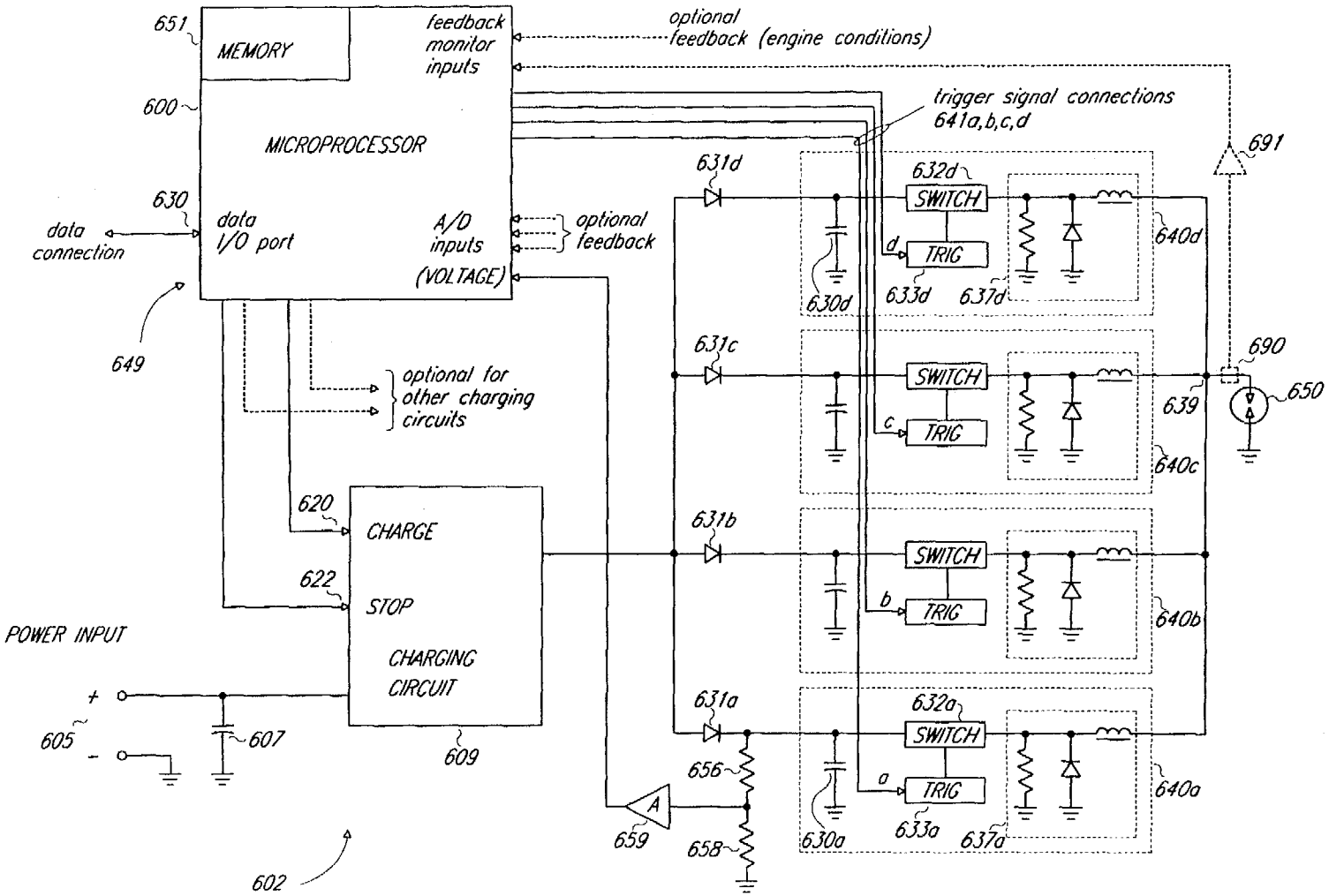
FIG. 6 is a schematic diagram of the preferred embodiment of the invention implemented using a microprocessor or microcontroller.

In the preferred embodiment illustrated in FIG. 6, the logic circuit 649 is implemented by a microprocessor 600. The microprocessor 600 is used to perform many of the logic functions described in connection with the embodiment shown in FIG. 1. In the microprocessor embodiment shown in FIG. 6, the microprocessor 600 performs the functions of the following elements of the FIG. 1 embodiment: the spark timer 25, trigger logic 43, the energy/delay matrix 45, the comparator 52, and HV reference 54. Depending upon the type of microprocessor employed, if the preferred charging circuit illustrated in FIG. 10*a* is used the microprocessor 600 may be optionally configured to perform the functions of the control circuit 110. It will be appreciated that the microprocessor 600 can also be configured to perform similar control functions with other charging circuits without departing from the scope or the spirit of the invention.

As shown in FIG. 6, the microprocessor 600 is provided with a data I/O port 630 which serves as a communications link between the microprocessor and an operator interface. This interface is most likely another computer or terminal with a keyboard input and display capabilities which allow an operator to program the apparatus via the data I/O port 630. Two alternative interfaces have been implemented and can be used interchangeably: a personal computer connected to the data I/O port 630 via the computer's SERIAL COM PORT, and a dedicated handheld terminal with simple display and keypad to enter the commands. In either case, the communication is optionally bi-directional, in which case the apparatus of FIG. 6 can also send status information back to the computer or handheld terminal using the data I/O port 630 as an output. Diagnostic information about the spark is a typical message. Optionally, the apparatus of FIG. 1 or FIG. 6 can be modified to generate such diagnostic information according to the methods and apparatus described in U.S. Pat. No. 5,155,437 and 5,343,154, the disclosures of which are hereby incorporated by reference.

Figure 7:
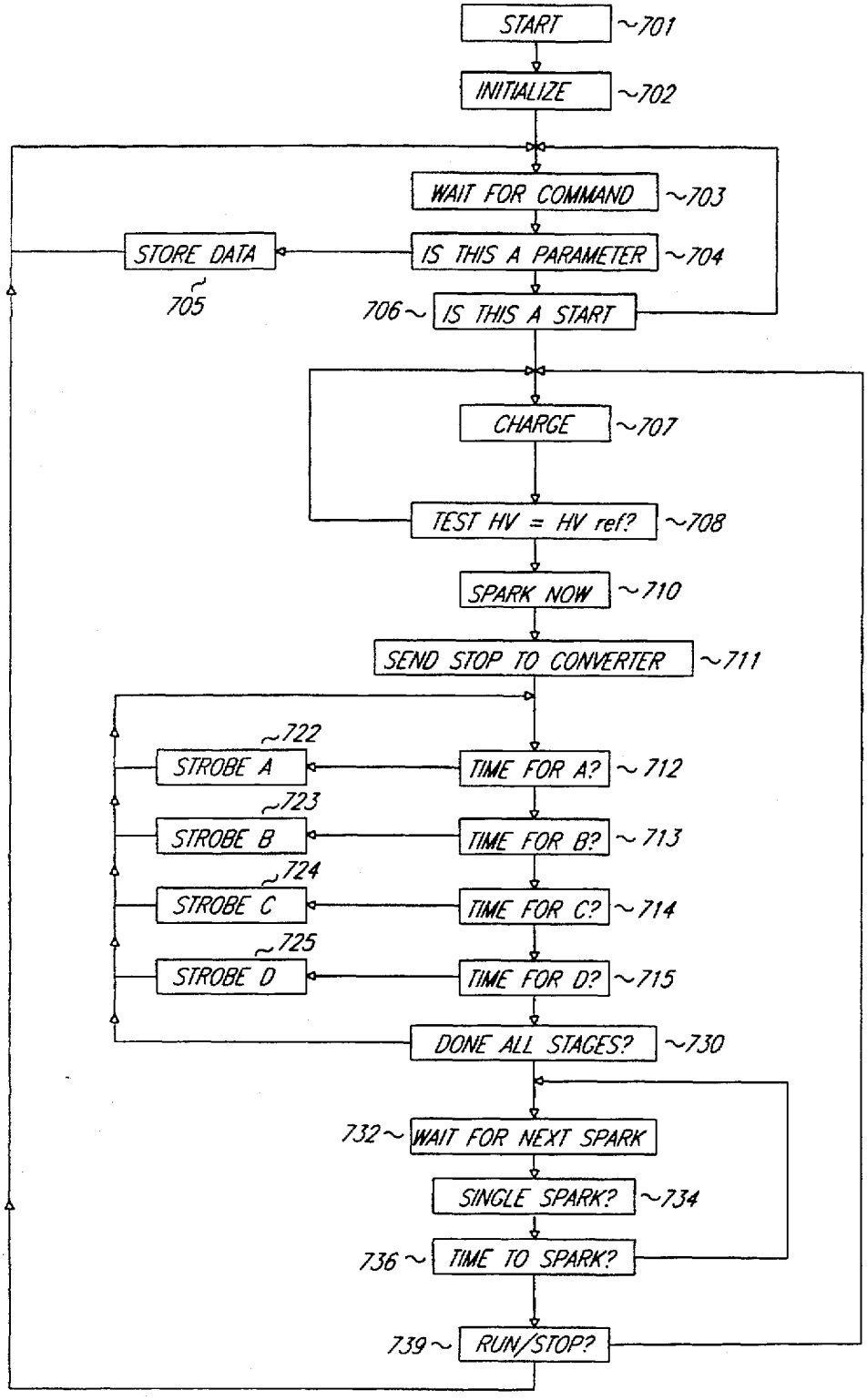
FIG. 7 is a flowchart illustrating the sequence of program steps followed by the microprocessor illustrated in FIG. 6.

In the microprocessor based embodiment shown in FIG. 6, the microprocessor 600 preferably executes the program illustrated by the flowchart of FIG. 7. The flowchart conforms to the code incorporated into the preferred embodiment of the invention. Those skilled in the art will appreciate, however, that many similar programs could be implemented without departing from the scope or the spirit of the invention.

The microprocessor 600 begins at the START 701 block when power is applied. Following the arrows in FIG. 7, the next step INITIALIZE 702 performs necessary housekeeping to configure the processor for operation. Such housekeeping includes enabling certain input and output lines and starting the data I/O port 630.

Referring again to FIG. 7, after completing the housekeeping stage, the microprocessor 600 enters the WAIT FOR COMMAND 703 loop and no further action will occur until the processor 600 receives a command. Two types of commands are expected; and either will cause an exit from the WAIT FOR COMMAND 703 loop. The first type of command is a parameter signal indicative of the various operating parameters of the device. The second type of command is the FIRE signal. When a signal is received, the microprocessor 600 will determine whether it is a parameter as represented by decision block 704. If it is a parameter, then the processor will STORE THE DATA 705 at an appropriate address in its associated memory 651 (shown in FIG. 6) and return to the WAIT FOR COMMAND 703 loop. Other parameters which may be received at this time correspond to the commands described in connection with FIG. 1 and include: the RATE command, the SPARK command, the ENERGY command, TIMING commands, and the HV command which control various aspects of the spark generation process.

Turning back to FIG. 7, the second possible exit from the WAIT FOR COMMAND 703 loop is via the IS THIS A START? 706 decision. If the received command requests a spark, or a series of continuing sparks, then the program follows the "yes" arrow to the CHARGE block 707 which starts a charge cycle by enabling the charging circuit 609 via its CHARGE input 620. The program next enters the TEST HV (is HV equal to HV reference?) block 708. The processor performs an A/D (analog-to-digital) conversion on the input from the voltage sensing circuit (implemented by resistors 656, 658 and buffer amplifier 659) and compares the result with the data stored in the memory [651] corresponding to the previously stored HV command. The microprocessor 600 then waits for the capacitors [30] to build up the required voltage. In an advanced program, the program may include a timeout so that if the expected voltage level is not reached within a limited time then the microprocessor 600 stops the charging circuit 609 and generates an error message.

It should be appreciated by those skilled in the art that if separate converters (as in FIG. 2) are employed in a microprocessor-based circuit similar to that shown in FIG. 6, then a plurality of voltage feedback signals would be available to the microprocessor. Thus, the program executed by the processor could be modified to exercise individual control over the charging of each output stage. In this regard, the microprocessor 600 of FIG. 6 is illustrated with optional feedback inputs for the other stages, as well as optional control outputs for the CHARGE and STOP inputs of the other converters.

Referring again to FIG. 7, the microprocessor 600 exits the TEST HV? 708 block when it determines that the value received from the voltage sensing circuit is equal to the stored HV parameter. The processor 600 then generates the software equivalent of the FIRE signal by exiting to the SPARK NOW 710 section of the program. At SEND STOP 711, the microprocessor 600 immediately generates an output signal which it transmits to the STOP input 622 of the charging circuit 609.

The microprocessor 600 then performs similar time-delayed triggering functions for each of the output stages [40] of the apparatus. Specifically, as represented by the decision blocks TIME FOR A? 712, TIME FOR B? 713, TIME FOR C? 714, and TIME FOR D? 715, the microprocessor 600 checks the parameters stored in its associated memory which correspond to the timing commands described above. If the operation indicated by the TIME FOR A? decision 712 indicates that it is time to fire Stage "A", the microprocessor enters the STROBE A step 722 and generates the trigger signal over connection 641*a* which causes output stage 640*a* to transfer its stored energy to the spark generating device 650. Similarly, affirmative outcomes at the other timing decision blocks 713, 714, 715 cause the microprocessor 600 to generate trigger signals as represented by logic boxes STROBE B 723, STROBE C 724, and STROBE D 725. A final question in the SPARK NOW 710 loop is DONE (ALL STAGES)? 730 which uses the parameter previously stored in the memory 651 by the ENERGY command to determine whether all of the stages to be fired in this spark event have been discharged. As mentioned above, the ENERGY parameter controls which of the stages must be discharged to achieve the correct total energy. Some stages are disabled and will not fire during the current spark event, while others will be triggered after a predetermined delay. When the DONE (ALL STAGES)? 730 decision is affirmative, the microprocessor 600 exits to the WAIT FOR NEXT SPARK step 732.

The WAIT FOR NEXT SPARK 732 function is the software equivalent of the spark timer described above in connection with FIG. 1. If the parameter stored by the RATE command has a value of zero, then the microprocessor 600 knows that the previous event was a single spark. This decision is represented by the SINGLE SPARK? block 734 in FIG. 7. In the "yes" case, the microprocessor 600 returns to the state represented by the WAIT FOR COMMAND block 703 in FIG. 7 and repeats the method described above.

In the "no" case, the microprocessor 600 will generate a series of sparks at a rate previously stored by the RATE command. In such a case, represented by the final decision block entitled TIME TO SPARK? 736, the microprocessor 600 uses the non-zero parameter stored by the RATE command to create a delay between the successive sparks so that the desired sparks per second rate is achieved. The microprocessor 600 then either remains in the WAIT FOR NEXT SPARK loop 732, or exits to the RUN/STOP? decision block 739.

There are several ways to implement the RUN/STOP function. In the preferred embodiment, it is accomplished by a maintained signal that shares the communications input at the data I/O port 630 in FIG. 6. The microprocessor 600 tests once-per-spark to make sure that the signal is still asserted (i.e. the RUN condition is still present). Upon verification of the RUN signal, the microprocessor 600 returns to the CHARGE block 707 where it begins the next spark cycle.

If the RUN signal is not detected, the microprocessor 600 ceases sparking and returns to the WAIT FOR COMMAND loop 703 where it resumes normal communications and waits for a command. The rationale for this extra step in the preferred embodiment is the usual presence of severe electrical noise in discharge apparatus of this type. The communication of a specific "stop" command as a coded signal could be disrupted since it occurs while the apparatus is sparking, whereas a simple maintained (constant) signal is extremely reliable. Finally, it allows the computer/terminal to be disconnected after loading parameters into the microprocessor memory 651, and a simple on/off switch to be used to start and stop the sparking thereafter.

Figure 8:
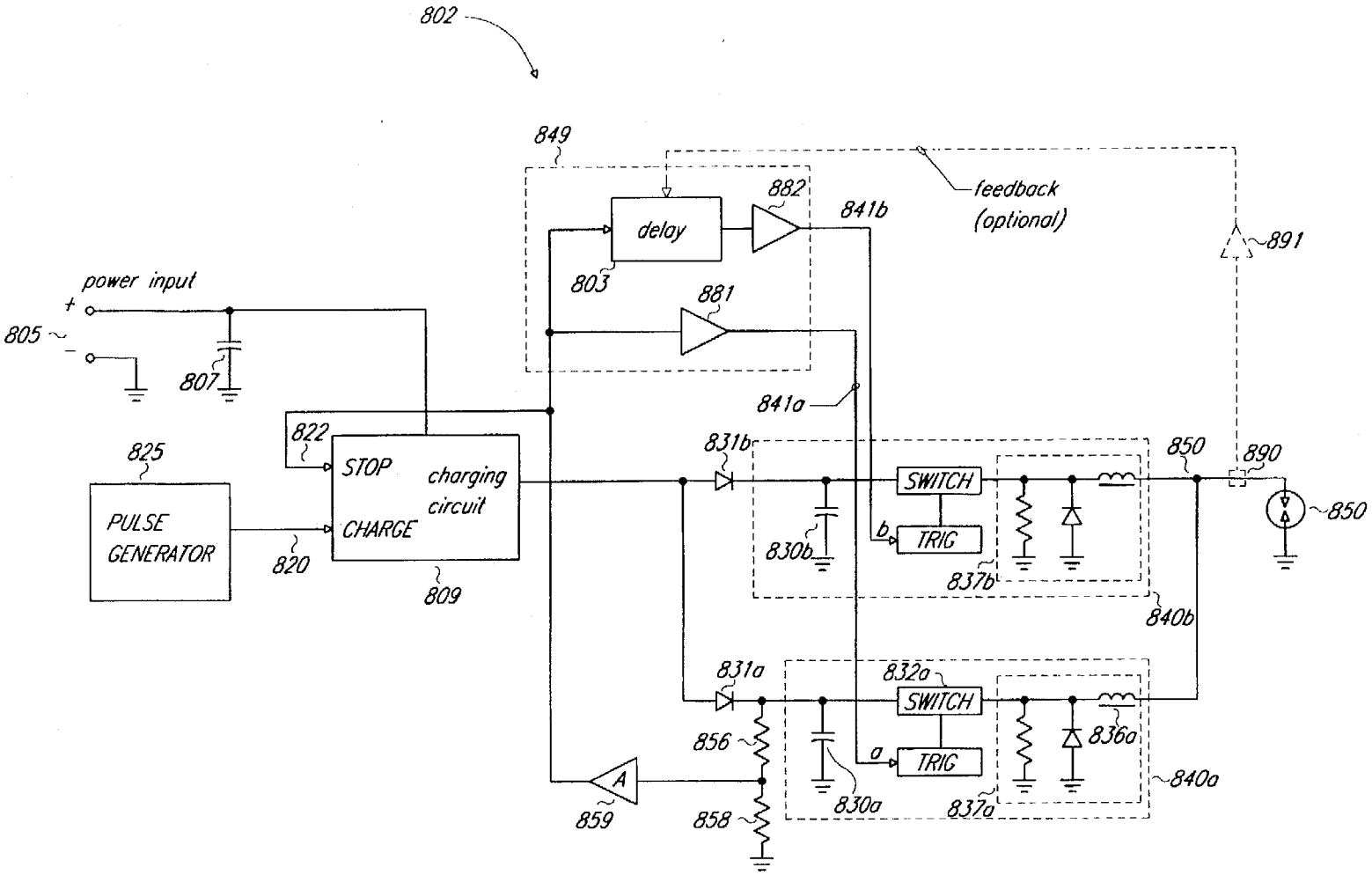
FIG. 8 is a schematic diagram illustrating a simplified embodiment which is directed to a specific aircraft turbine engine ignition application.

Those skilled in the art will appreciate that the circuits 2, 602 illustrated in FIGS. 1 and 6 are capable of generating sparks having virtually any energy level and plume shape. Thus, the circuits 2, 602 are particularly well suited for use in a piece of test equipment which can be employed to determine the optimum plume shape and energy level of sparks generated for a particular application. Those skilled in the art will further appreciate that in production ignition apparatus not intended for use as testing devices, this level of adjustability would typically not be necessary or desirable. In those cases the circuits 2, 602 of FIGS. 1 and 6 could be modified to consistently generate sparks having a specified plume shape and energy level to provide the most reliable ignition performance for the particular application in which the circuits are being used. In addition, the circuits 2, 602 of FIGS. 1 and 6 could be simplified to include only the circuitry needed to generate the desired sparks. An example of such a circuit 802 is illustrated in FIG. 8 and will now be described in detail. Those skilled in the art will appreciate that the circuits 2, 602 of FIGS. 1 and 6, the circuit 802 of FIG. 8, and other circuits constructed in accordance with the invention defined in the appended claims, all fall within the scope and the spirit of the invention.

Aircraft turbine ignition is one example of an application where the full scope of precision and flexibility offered by other embodiments such as those illustrated in FIGS. 1 and 6 is not required. In fact, other environmental and system constraints are more important dictates of the final form of a production apparatus for this particular application.

FIG. 8 illustrates an aircraft turbine ignition system constructed in accordance with the teachings of the instant invention to produce sparks having a total of 7 Joules of stored energy at a spark rate of 2 sparks-per-second. The apparatus includes only two stages 840*a*, 840*b* designed to produce output pulses having 2 Joules and 5 Joules of energy, respectively. Although the addition of more stages would enable additional spark shaping, limiting the apparatus 802 to two stages is preferred in this instance because the apparatus achieves high reliability, small size, and economic efficiencies by minimizing the complexity of the circuitry. In this case, the 2:5 energy split is chosen to be within the upper (5 Joule) limit for the particular device chosen for the controlled switch 832*b*. The spark timer or pulse generator 825 delivers signals to the CHARGE input 820 of charging circuit 809 at a 2 Hertz rate to produce 2 sparks per second.

In order to provide a lower stress environment for the igniter plug 850, the circuit 802 of FIG. 8 includes a simplified logic circuit 849 which activates trigger signal connection 841*a* via driver gate 881 immediately upon receiving the FIRE signal. This fires the 2 Joule (smaller) stage 840*a* to form the plasma and begin delivering the energy to the plug 850. The logic circuit 849 further includes time delay circuitry 803 which delays the activation of trigger signal 841*b* (via driver gate 882) by a predetermined length of time to effect a time-delayed delivery of the bulk energy of the 5 Joule stage 840*b*. This arrangement limits the energy delivered to the igniter plug 850 during the initial plasma-forming discharge thereby reducing the stress and arc-induced erosion imposed on the electrodes of the plug 850 by the spark event and, consequently, increasing the useful life of the igniter plug 850.

In this application the value of the fixed delay is chosen to fire the 5 Joule stage when the 2 Joule stage output current has decayed to a threshold of approximately 20 percent of its peak value. However, this choice is highly dependent on the specific application. Other delays and/or other thresholds may be preferable in other applications. The renewed surge of energy when the 5 Joule stage fires enlarges and extends the plume shape in the direction away from the igniter plug tip surface, thus enabling it to reach further into the ignitable mixture and increasing the probability of a successful ignition event. At the same time, the delayed surge of energy lengthens the time duration of the spark plume.

Those skilled in the art will appreciate, that, instead of employing the simple delay circuit/timer described above, the desired time delay could be obtained by providing appropriate sensing and feedback circuitry for monitoring the output current being provided to the plug 850. This sensing and feedback circuitry would enable the logic circuit to determine when the initial current pulse falls to the aforementioned 20% level and, thus, when it is time to fire the second stage 840*b*.

If such an approach is taken, the optional feedback circuitry may include a current monitor 890 and an amplifier 891 which together provide feedback to the logic circuit 849. Although the monitor 890 has been illustrated as a separate device in FIG. 8, those skilled in the art will appreciate that it may be advantageous to implement the optional monitor 890 by incorporating an extra winding into the existing inductors [836] of the output networks [837]. This approach is also described in the above-mentioned '073 and '252 Patents.

Those skilled in the art will appreciate that any appropriate feedback circuitry can be employed with any of the embodiments of the invention illustrated herein to provide additional control over the output waveforms. For example, an appropriate sensor 690 and amplifier 691 can be added to the microprocessor-based embodiment of the invention illustrated in FIG. 6 to both monitor the output pulse being transmitted to the igniter plug 650 and provide the microprocessor 600 with a feedback signal to provide further control of the waveshape and energy level of the output pulses generated by the apparatus without departing from the scope or the spirit of the invention. In addition, those skilled in the art will appreciate that the feedback signals generated by the sensor 690 can be used to obtain diagnostic information as taught by the previously referenced '154 and '437 Patents. It will further be appreciated that the microprocessor 600 or other logic circuit 649 can be adapted to perform adaptive control by modifying the output waveshape (including its energy level) in response to the diagnostic information. For example, this adaptive control could be used to raise the voltage of the output waveform to enhance ionization if it were detected that the spark generating device had failed to produce a spark in response to an earlier output waveform.

Optionally, additional feedback signals obtained from the engine can also be added as inputs to the microprocessor 600 of FIG. 6 or to the simplified logic circuit 849 of FIG. 8. An example of such a signal and its anticipated use is illustrated in FIG. 8. In this instance, combustor temperature is monitored and used to disable the 5 Joule (delayed) firing if the monitored temperature exceeds a predetermined level. Thus, the total energy output to the spark generating device is limited to only 2 Joules to limit the stress imposed upon the igniter plug 650 whenever the combustor is hot enough to ignite or re-ignite with the lesser energy (2 Joule) sparks.

Figure 9:
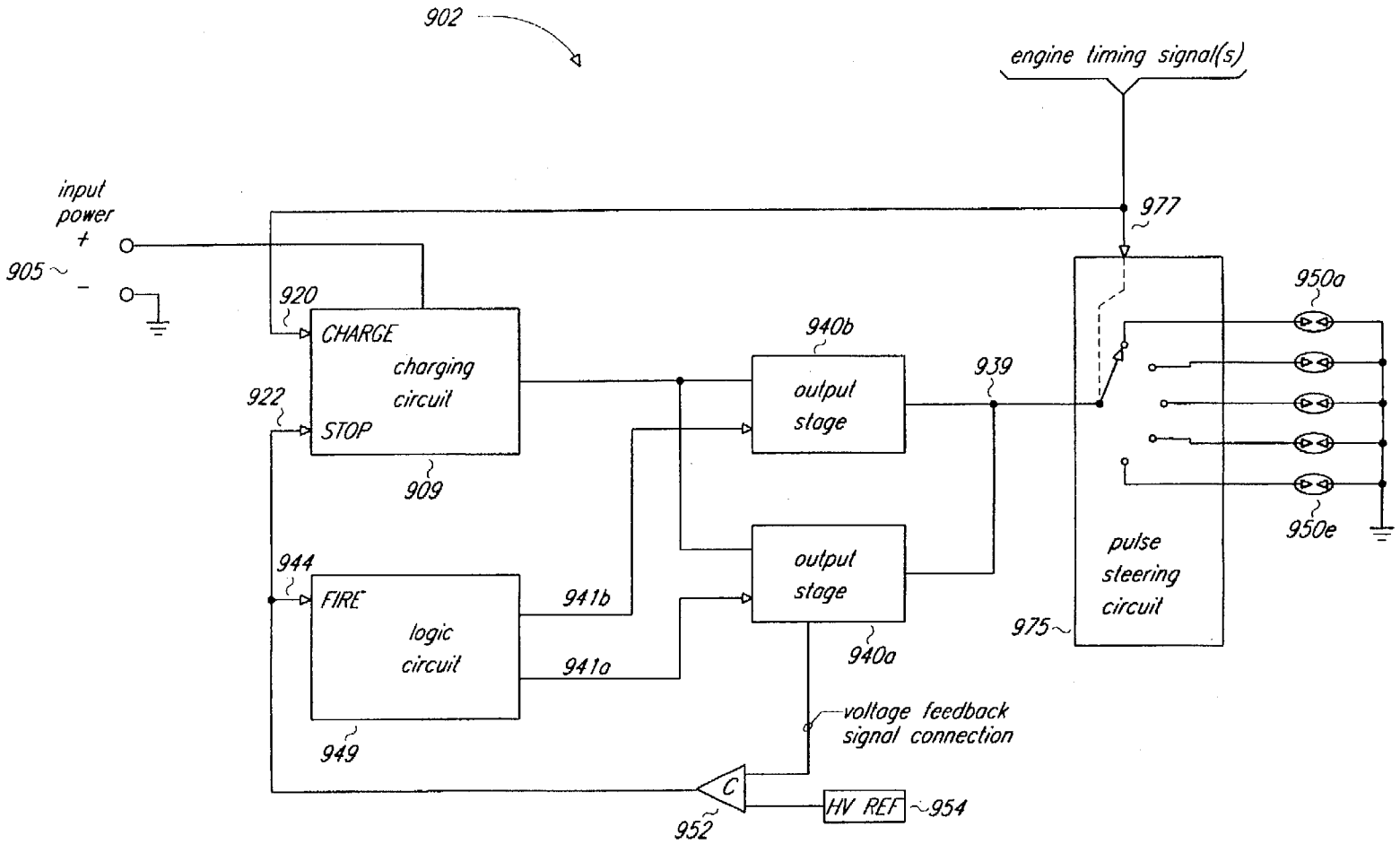
FIG. 9 is a schematic diagram of another alternative embodiment of the invention adapted for use as a high-rate, multi-output ignition system.

Another alternative embodiment of the invention is illustrated generally in FIG. 9. This multi-output ignition circuit 902 is designed to generate a high spark rate and to selectively deliver or distribute its output pulse to a plurality of spark generating devices [950] such as spark plugs in an automobile engine. To this end, the circuit 902 of FIG. 9 includes two output stages [940] which are sequentially triggered by the logic circuit 949 to produce a closely spaced sequence of non-overlapping pulses.

Although the illustrated embodiment employs only two output stages [940], those skilled in the art will appreciate that, like all of the other embodiments illustrated herein, the multi-output ignition circuit 902 of FIG. 9 can be implemented with any multiple number of output stages [940]. Employing multiple output stages [940] reduces the thermal and voltage stresses on each individual stage by providing relaxation time for the fired stages while the other stages take their turns at delivering an output pulse. Those skilled in the art will further appreciate that, in applications requiring a high spark rate, multiple charging circuits [909] can be employed in accordance with the above teachings to re-charge the exhausted stages [940] while the logic circuit 949 fires the other stages [940] in cyclical fashion. Those skilled in the art will also appreciate that this high spark rate technique can likewise be employed in single output applications employing a single spark generating device but requiring a high spark rate without departing from the scope or the spirit of the invention. Under these circumstances, the pulse steering circuit is not required and is, therefore, omitted.

In order to distribute the output pulses to a plurality of spark generating devices [950], the circuit 902 additionally includes pulse steering circuit 975 which receives pulses from the junction 939 and sequentially routes them to each spark plug. The distribution to and firing of the spark plugs must be synchronized with the engine operation which is accomplished by one or more timing signals received from the engine at input 977. Because the spark events must occur at specific times under control of the engine, the same timing signal is also connected directly to the CHARGE input 920 of the charging circuit 909 which eliminates the need for the spark timer 25 shown in FIG. 1. The FIRE signal 944, which is also the STOP input 922 for charging circuit 909, is generated as before by comparator 952 which compares the voltage signal from stage 940*a* with the HV reference 954.

Those skilled in the art will appreciate that the pulse steering circuit 975 may be implemented in numerous conventional ways known in the art without departing from the scope or the spirit of the instant invention. For example, the pulse steering circuit 975 may be a mechanical distributor such as those commonly used in automotive applications or it may be a fully electronic switching network comprised of a group of controlled switches substantially like those described in connection with the output stages [40] but triggered singly in a mutually-exclusive fashion. Any of these approaches are currently equally preferred.

Those skilled in the art will appreciate that although many of the embodiments illustrated herein employ output stages having a grounded-capacitor configuration, a grounded-switch configuration wherein the positions of the capacitor and the controlled switch are reversed could likewise be employed without departing from the scope or the spirit of the invention. Similarly, those skilled in the art will appreciate that although in many of the embodiments illustrated herein, the output stages have been configured to discharge current of a given polarity, the output stages could be configured to pass current of the opposite polarity such that the discharge current flows through the spark generating device in a direction opposite to the current flow in FIG. 1 without departing from the scope or the spirit of the invention.

Although the invention has been described in connection with certain embodiments, it will be understood that there is no intent to in any way limit the invention to those embodiments. On the contrary, the intent is to cover all alternatives, modifications and equivalents included within the spirit and scope of the invention as defined by the appended claims.

We claim:

1. An apparatus for controllably generating sparks, the apparatus comprising, in combination:

a spark generating device;

at least two output stages connected to the spark generating device, each of the output stages including: (1) an energy storage device to store energy; (2) a controlled switch for selectively discharging the energy storage device; and (3) a network for transferring the energy discharged by the energy storage device to the spark generating device means for charging the energy storage devices and at least partially isolating the energy storage device of each output stage from the energy storage devices of the other output stages; and, a logic circuit connected to the controlled switches of the at least two output stages for selectively triggering all of the output stages to transfer substantially all of their stored energy to the spark generating device to generate the spark;

wherein at least one of the controlled switches is triggered at a different time than the other controlled switches and the energy output by the output stage including the at least one of the controlled switches partially overlaps with the energy output by another output stage to shape the plume of the spark generated by the spark generating device.

2. An apparatus for controllably generating sparks comprising:

a spark generating device for generating sparks in response to an energy pulse received at an input;

a first capacitor to store and selectively discharge energy;

a first controlled switch connected to the first capacitor to selectively discharge the energy stored in the first capacitor to the input of the spark generating device in response to a first control signal;

a second capacitor to store and selectively discharge energy;

a second controlled switch connected to the second capacitor to selectively discharge the energy stored in the second capacitor to the input of the spark generating device in response to a second control signal;

means for charging the first and second capacitors and for at least partially isolating the first capacitor from the second capacitor such that either of the first and second capacitors can be discharged without discharging the other; and, a logic circuit for providing the first and second control signals to the first and second controlled switches, respectively, to selectively discharge the first and second capacitors to the input of the spark generating device, wherein the logic circuit triggers the first controlled switch at a different time than the second controlled switch to shape the plume of the spark generated by the spark generating device; and, the energy output via the first controlled switch partially overlaps with the energy output via the second controlled switch.

3. An apparatus as defined in claim 2 wherein the charging and isolating means comprises first and second charging circuits, the first and second charging circuits being associated with the first and second capacitors, respectively, the first charging circuit being configured to charge and allow discharging of the first capacitor independently of the second capacitor and the second charging circuit being configured to charge and allow discharging of the second capacitor independently of the first capacitor.

4. An apparatus as defined in claim 2 wherein the charging and isolating means comprises a first diode associated with the first capacitor, a second diode associated with the second capacitor, and a charging circuit for selectively charging the first and second capacitors to an energy source via the first and second diodes.

5. An apparatus as defined in claim 4 wherein the charging circuit comprises at least one converter.

6. An apparatus as defined in claim 2 wherein the first and second controlled switches are solid-state devices.

7. An apparatus as defined in claim 2 wherein the first and second capacitors have different capacitances.

8. An apparatus as defined in claim 2 wherein the logic circuit comprises a microprocessor.

9. An apparatus as defined in claim 2 wherein the logic circuit comprises a timer for discharging one of the first and second capacitors later in time than the other.

10. An apparatus for controllably generating sparks, the apparatus comprising, in combination:

a spark generating device;

a first converter;

a first output stage connected to the first converter and to the spark generating device, the first output stage including: (1) an energy storage device to store the energy received from the first converter; (2) a controlled switch for selectively discharging the energy storage device; and (3) a network for transferring the energy discharged by the energy storage device to the spark generating device;

a second converter;

a second output stage connected to the second converter and to the spark generating device, the second output stage including: (1) an energy storage device to store the energy received from the second converter; (2) a controlled switch for selectively discharging the energy storage device; and (3) a network for transferring the energy discharged by the energy storage device to the spark generating device; and, a logic circuit connected to the controlled switches of the first and second output stages for selectively triggering the output stages to transfer their stored energy to the spark generating device to generate the spark;

wherein each of the networks of the first and second output stages includes an inductor, and the inductor in the network of the first output stage comprises a first winding of a transformer, and the inductor in the network of the second output stage comprises a second winding of the transformer, the second winding being magnetically coupled to the first winding of the transformer to induce a high voltage therein when the second output stage is triggered.

11. An apparatus for controllably generating sparks, the apparatus comprising, in combination:

a spark generating device;

at least two output stages connected to the spark generating device, each of the output stages including: (1) an energy storage device to store energy; (2) a controlled switch for selectively discharging the energy storage device; and (3) a network for transferring the energy discharged by the energy storage device to the spark generating device;

means for charging the energy storage devices and at least partially isolating the energy storage device of each output stage from the energy storage devices of the other output stages; and, a logic circuit connected to the controlled switches of the at least two output stages for selectively triggering the output stages to transfer their stored energy to the spark generating device to generate the spark;

wherein each of the networks of the at least two output stages includes an inductor, and the inductor in the network of a first one of the at least two output stages comprises a first winding of a transformer, and the inductor in the network of a second one of the at least two output stages comprises a second winding of the transformer, the second winding being magnetically coupled to the first winding of the transformer to induce a high voltage therein when the second one of the at least two output stages is triggered.

12. An apparatus as defined in claim 1 wherein the spark generating device is an igniter plug.

13. An apparatus as defined in claim 1 wherein the spark generating device is a spark plug.

14. An apparatus as defined in claim 1 the spark generating device is incorporated into a spacecraft thruster.

15. An apparatus as defined in claim 1 wherein the spark generating device is a spark rod.

16. An apparatus as defined in claim 1 wherein the energy storage device is a capacitor.

17. An apparatus as defined in claim 16 wherein the energy storage devices of the at least two output stages have different capacitances.

18. An apparatus as defined in claim 17 wherein the capacitances of the energy storage devices are binary weighted.

19. An apparatus as defined in claim 1 wherein the controlled switches of the output stages comprise solid-state switches.

20. An apparatus as defined in claim 19 wherein the solid-state switches of the output stages comprise silicon controlled rectifiers.

21. An apparatus as defined in claim 1 wherein each of the at least two output stages further includes a triggering circuit coupled to the controlled switch and to the logic circuit for triggering the controlled switch in response to a control signal from the logic circuit.

22. An apparatus as defined in claim 1 wherein at least one of the networks of the at least two output stages comprises an inductor connected so as to pass current when the controlled switch becomes conductive such that the current passes through both the inductor and the spark generating device, and a diode to ensure nominally unidirectional current flow through the spark generating device.

23. An apparatus as defined in claim 22 further comprising a resistor and an inductor in each network of the at least two output stages and wherein the inductor and the resistor of each network form a low-pass filter to prevent untriggered ones of the at least two output stages from being false triggered by the discharging of any of the other output stages.

24. An apparatus for controllably generating sparks, the apparatus comprising, in combination;

a spark generating device;

a first converter;

a first output stage connected to the first converter and to the spark generating device, the first output stage including: (1) an energy storage device to store the energy received from the first converter; (2) a controlled switch for selectively discharging the energy storage device; and (3) a network for transferring the energy discharged by the energy storage device to the spark generating device;

a second converter;

a second output stage connected to the second converter and to the spark generating device, the second output stage including: (1) an energy storage device to store the energy received from the second converter; (2) a controlled switch for selectively discharging the energy storage device; and (3) a network for transferring the energy discharged by the energy storage device to the spark generating device; and, a logic circuit connected to the controlled switches of the first and second output stages for selectively triggering each of the output stages to transfer substantially all of their stored energy to the spark generating device to generate the spark;

wherein the first controlled switch is triggered at a different time than the second controlled switch and the energy output by the first output stage partially overlaps with the energy output by the second output stage to shape the plume of the spark generated by the spark generating device.

25. An apparatus as defined in claim 1 further comprising an inductor in each network of the at least two output stages and wherein the inductor in the network of the first output stage comprises a first winding of a transformer, and the inductor in the network of the second output stage comprises a second winding of the transformer, the second winding being magnetically coupled to the first winding of the transformer to induce a high voltage therein when the second output stage is triggered.

26. An apparatus for controllably generating sparks, the apparatus comprising, in combination:

a spark generating device;

at least two output stages connected to the spark generating device, each of the output stages including: (1) an energy storage device to store energy; (2) a controlled switch for selectively discharging the energy storage device; and (3) a network for transferring the energy discharged by the energy storage device to the spark generating device;

means for charging the energy storage devices and at least partially isolating the energy storage device of each output stage from the energy storage devices of the other output stages; and, a logic circuit connected to the controlled switches of the at least two output stages for selectively triggering the output stages to transfer their stored energy to the spark generating device to generate a spark, wherein the logic circuit triggers the controlled switches in all of the output stages to transfer substantially all of the energy stored in the output stages to the spark generating device; the logic circuit triggers at least one of the controlled switches at a different time than at least one other controlled switch to shape the plume of the spark generated by the spark generating device; and, the energy output by the output stage, including the at least one of the controlled switches, partially overlaps with the energy output by another output stage.

27. An apparatus as defined in claim 1 wherein at least one of the networks of the at least two output stages comprises an inductor connected so as to pass current to and from the spark generating device, and a diode coupled in parallel with the controlled switch to permit reverse current flow during bipolar discharge.

28. An apparatus as defined in claim 27 further comprising a resistor and an inductor in each network of the at least two output stages and wherein the inductor and the resistor of each network form a low-pass filter to prevent untriggered ones of the at least two output stages from being false triggered by the discharging of any of the other output stages.

29. An apparatus as defined in claim 1 wherein each of the networks of the at least two output stages includes a diode to at least partially isolate each of the at least two output stages from the other output stages.

30. An apparatus as defined in claim 1 wherein the charging and isolating means comprises a charging circuit and at least two isolating diodes, each of the isolating diodes being associated with one of the at least two output stages.

31. An apparatus as defined in claim 30 wherein the charging circuit comprises at least one controlled switch for selectively connecting the output stages to a source of energy.

32. An apparatus as defined in claim 30 wherein the charging circuit comprises a flyback converter for selectively providing energy to the output stages.

33. An apparatus as defined in claim 32 wherein the flyback converter includes at least one input for switching the converter between a charge state and a stop state for controlling the charging of the energy storage devices.

34. An apparatus as defined in claim 30 wherein the charging circuit charges each of the output stages to substantially the same voltage.

35. An apparatus as defined in claim 30 wherein the charging circuit charges at least one of the output stages to a different voltage than the other output stages.

36. An apparatus as defined in claim 30 wherein the charging circuit disconnects the output stages from the energy source at least while the energy storage devices are discharging.

37. An apparatus as defined in claim 36 wherein the controlled switches of the output stages comprise silicon controlled rectifiers and wherein the disconnection of the energy source permits the silicon controlled rectifiers to transition to their non-conducting states.

38. A method for controllably generating sparks at a spark generating device, the method comprising the steps of:

charging a first energy storage device to a first predetermined voltage;

charging a second energy storage device which is at least partially isolated from the first energy storage device to a second predetermined voltage;

triggering a first controlled switch associated with the first energy storage device at a first time to discharge the first energy storage device to the spark generating device in the form of an energy pulse; and, triggering a second controlled switch associated with the second energy storage device at a second time to discharge the second energy storage device to the spark generating device in the form of an energy pulse; wherein the energy pulse discharged by the first energy storage device at least partially overlaps with the energy pulse discharged by the second energy storage device.

39. An apparatus as defined in claim 1 wherein the charging and isolating means comprises at least two charging circuits, each of the charging circuits being associated with one of the at least two stages for charging the energy storage devices independently of one another.

40. An apparatus as defined in claim 39 wherein at least one of the charging circuits charges its associated output stage to a voltage different from at least one of the other output stages.

41. An apparatus as defined in claim 40 wherein the logic circuit triggers the output stage associated with the at least one of the charging circuits earlier in time than at least one other output stage to deliver an initial pulse to the spark generating device.

42. An apparatus as defined in claim 1 further comprising a feedback circuit connected between at least one of the output stages and the charging and isolating means for controlling the charging of the energy storage devices in the output stages.

43. An apparatus as defined in claim 42 wherein the feedback circuit comprises a voltage sensing network for measuring the voltage across the energy storage device in the at least one of the output stages and a comparator for comparing the measured voltage to a reference voltage, the charging and isolation means terminating the charging of the output stages when the comparator indicates that the measured voltage and the reference voltage coincide.

44. An apparatus as defined in claim 43 wherein the comparator provides the logic circuit with a fire signal when the measured voltage and the reference voltage coincide and the logic circuit selectively triggers the controlled switches in response to the fire signal to create a spark.

45. An apparatus as defined in claim 1 wherein the logic circuit comprises a timer for delaying the discharge of at least one of the output stages relative to the other output stages.

46. An apparatus as defined in claim 1 wherein the logic circuit comprises a trigger logic circuit and an energy/delay matrix, the energy/delay matrix containing information indicating which of the output stages are to be fired.

47. An apparatus as defined in claim 1 wherein the logic circuit comprises a trigger logic circuit and an energy/delay matrix, the energy/delay matrix containing information indicating that at least one of the output stages should be triggered later in time than the other output stages.

48. An apparatus as defined in claim 1 wherein the logic circuit comprises a microprocessor for controlling the triggering of the at least two output stages.

49. An apparatus as defined in claim 48 wherein the logic circuit further comprises a memory associated with the microprocessor for storing data indicating which of the at least two output stages are to be fired.

50. An apparatus as defined in claim 48 wherein the logic circuit further comprises a memory associated with the microprocessor for storing data indicating that at least one of the output stages should be triggered later in time than the other output stages.

51. An apparatus as defined in claim 1 wherein the networks are coupled to a common output connected to the spark generating device, and a feedback circuit is coupled to the logic circuit and to the common output to enable the logic circuit to monitor the energy being transferred to the spark generating device.

52. An apparatus as defined in claim 1 further comprising at least a second spark generating device and steering circuitry coupled to the networks of the at least two output stages to selectively direct the stored energy transferred by the output stages to one of the spark generating devices.

53. An apparatus as defined in claim 52 wherein the steering circuitry directs the stored energy to each of the spark generating devices sequentially.

54. An apparatus as defined in claim 1 wherein the spark generating device is associated with an engine, the engine including sensors coupled to the logic circuit for providing feedback signals to the logic circuit indicative of at least one operating condition of the engine.

55. A method as defined in claim 38 wherein the first predetermined voltage and the second predetermined voltage are substantially equal.

56. A method as defined in claim 38 wherein the first predetermined voltage and the second predetermined voltage are different.

57. A method as defined in claim 38 wherein the first energy storage device has a first capacitance and the second energy storage device has a second capacitance, the first capacitance being substantially equal to the second capacitance.

58. A method as defined in claim 38 wherein the first energy storage device has a first capacitance and the second energy storage device has a second capacitance, the first capacitance being different from the second capacitance.

59. A method as defined in claim 38 wherein the first time and the second time are substantially the same.

60. A method as defined in claim 38 wherein the energy pulse discharged by the first energy storage device completely overlaps with the energy pulse discharged by the second energy storage device.

61. A method as defined in claim 38 wherein the first time occurs later than the second time.

62. A method as defined in claim 61 wherein the energy pulse discharged by the first energy storage device does not overlap with the energy pulse discharged by the second energy storage device.

* * * * *